US011078772B2

(12) United States Patent
Wassell et al.

(10) Patent No.: US 11,078,772 B2
(45) Date of Patent: Aug. 3, 2021

(54) DRILLING SYSTEM FOR MONITORING AND DISPLAYING DRILLING PARAMETERS FOR A DRILLING OPERATION OF A DRILLING SYSTEM

(71) Applicant: APS Technology, Inc., Wallingford, CT (US)

(72) Inventors: Mark Ellsworth Wassell, Houston, TX (US); Rudolph Popeszku, Houston, TX (US)

(73) Assignee: APS Technology, Inc., Wallingford, CT (US)

( * ) Notice: Subject to any disclaimer, the term of this patent is extended or adjusted under 35 U.S.C. 154(b) by 0 days.

(21) Appl. No.: 14/026,332

(22) Filed: Sep. 13, 2013

(65) Prior Publication Data

US 2015/0014058 A1 Jan. 15, 2015

Related U.S. Application Data

(63) Continuation of application No. 29/460,812, filed on Jul. 15, 2013, now Pat. No. Des. 843,381.

(51) Int. Cl.
*E21B 44/00* (2006.01)

(52) U.S. Cl.
CPC ..... *E21B 44/00* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,309,941 | A * | 2/1943 | Drummond | B60K 37/00 116/299 |
| 3,507,341 | A | 4/1970 | Basgan | |
| 3,626,482 | A | 12/1971 | Quichaud et al. | |
| 3,813,656 | A | 5/1974 | Fowler | |
| 4,019,148 | A | 4/1977 | Shawhan | |
| 4,120,198 | A | 10/1978 | Tanguy et al. | |
| D253,691 | S | 12/1979 | Bljumshtein | |
| D253,811 | S | 1/1980 | Bljumshtein | |
| 4,254,481 | A | 3/1981 | Smither et al. | |
| D263,125 | S | 2/1982 | Taylor | |
| 4,380,172 | A | 4/1983 | Imam et al. | |
| 4,507,735 | A | 3/1985 | Moorehead et al. | |
| D293,422 | S | 12/1987 | Nunes | |
| 4,715,451 | A | 12/1987 | Bseisu et al. | |
| D302,394 | S | 7/1989 | Merrell | |

(Continued)

FOREIGN PATENT DOCUMENTS

| | | |
|---|---|---|
| CN | 1346929 A | 5/2002 |
| CN | 2721874 Y | 8/2005 |

(Continued)

OTHER PUBLICATIONS

APS Technology, Vibration Isolation Subs (VISI™), 2009, Rev. 090807, vA.

(Continued)

*Primary Examiner* — D. Andrews
*Assistant Examiner* — Ronald R Runyan
(74) *Attorney, Agent, or Firm* — Offit Kurman, P.A.; Gregory A. Grissett

(57) ABSTRACT

A drilling system and method for monitoring drilling parameters for an underground drilling operation.

13 Claims, 12 Drawing Sheets

(56) References Cited

U.S. PATENT DOCUMENTS 4,903,245 A 2/1990 Close et al.
D307,127 S 4/1990 Simons
4,954,998 A 9/1990 Rector
4,958,125 A 9/1990 Jardine et al.
4,968,930 A * 11/1990 Grupp ..... G01R 1/08 324/115
5,012,412 A * 4/1991 Helm ..... E21B 47/022 33/302
5,141,061 A 8/1992 Henneuse
5,160,925 A 11/1992 Dailey et al.
5,220,963 A 6/1993 Patton
5,226,332 A 7/1993 Wassell
5,259,468 A 11/1993 Warren et al.
5,269,383 A 12/1993 Forrest
5,314,030 A 5/1994 Peterson et al.
5,332,048 A 7/1994 Underwood et al.
5,358,059 A 10/1994 Ho
5,368,108 A 11/1994 Aldred et al.
5,448,911 A 9/1995 Mason
5,646,611 A 7/1997 Dailey et al.
D384,341 S 9/1997 Hoffman
5,721,376 A 2/1998 Pavane et al.
5,812,068 A 9/1998 Wisler et al.
5,842,149 A 11/1998 Harrell et al.
5,857,530 A 1/1999 Gronseth
5,880,680 A 3/1999 Wisehart et al.
6,012,015 A 1/2000 Tube
6,021,377 A 2/2000 Dubinsky et al.
6,023,658 A 2/2000 Jeffryes
6,088,294 A 7/2000 Leggett, III et al.
6,092,610 A 7/2000 Kosmala et al.
6,101,444 A 8/2000 Stoner
6,205,851 B1 3/2001 Jogi
6,206,108 B1 3/2001 MacDonald et al.
6,227,044 B1 5/2001 Jarvis
6,233,524 B1 5/2001 Harrell et al.
6,272,434 B1 8/2001 Wisler et al.
6,296,066 B1 10/2001 Terry et al.
6,308,787 B1 10/2001 Alft
6,310,559 B1 10/2001 Laborde et al.
D452,693 S 1/2002 Mitchell
6,347,282 B2 2/2002 Estes
6,371,204 B1 4/2002 Singh et al.
6,405,808 B1 6/2002 Edwards et al.
6,415,878 B1 7/2002 Cargill et al.
6,419,014 B1 7/2002 Meek et al.
6,466,235 B1 10/2002 Smith
D465,167 S 11/2002 Hayashi
6,547,016 B2 4/2003 Wassell
6,564,883 B2 5/2003 Fredericks et al.
6,609,579 B2 8/2003 Krueger et al.
6,637,523 B2 10/2003 Lee et al.
6,637,524 B2 10/2003 Kruspe et al.
6,662,110 B1 12/2003 Bargach et al.
6,714,138 B1 3/2004 Tumet
6,732,052 B2 5/2004 MacDonald
D493,397 S 7/2004 Tuzar
6,785,641 B1 8/2004 Huang
D496,940 S 10/2004 Fetterman
D499,367 S 12/2004 Sauter
6,883,393 B2 4/2005 Tadaaki
D511,167 S 11/2005 Blencowe
D511,704 S 11/2005 Zwingmann
6,968,909 B2 11/2005 Aldred
D514,996 S 2/2006 Rayburn
7,003,439 B2 2/2006 Aldred
7,020,597 B2 3/2006 Oliver
7,054,750 B2 5/2006 Rodney
7,064,676 B2 6/2006 Halle et al.
D525,550 S 7/2006 Egidio
7,073,125 B1 7/2006 Nystrom
7,100,688 B2 9/2006 Stephenson et al.
7,140,452 B2 11/2006 Hutchinson
7,142,986 B2 11/2006 Moran
D533,474 S 12/2006 Megale
7,168,506 B2 1/2007 Boucher et al.
7,172,037 B2 2/2007 Dashevskiy
D543,139 S 5/2007 Kraus
D543,476 S 5/2007 Barmettler
7,219,747 B2 5/2007 Gleitman et al.
7,225,879 B2 6/2007 Wylie et al.
D545,707 S 7/2007 Barmettler
7,243,719 B2 7/2007 Baron
7,243,735 B2 7/2007 Koederitz
7,251,590 B2 7/2007 Huang
D549,721 S 8/2007 Ito
D549,722 S 8/2007 Ito
D552,121 S 10/2007 Carl
D553,142 S 10/2007 Blencowe
D553,143 S 10/2007 Blencowe
D553,144 S 10/2007 Blencowe
D555,164 S 11/2007 Sergio
7,313,480 B2 12/2007 Chen et al.
7,327,634 B2 2/2008 Perry
D563,977 S 3/2008 Carl
7,357,197 B2 4/2008 Schultz et al.
D568,776 S 5/2008 Hall
7,441,189 B2 10/2008 Michaels
D581,302 S 11/2008 Wyszogrod
D589,388 S 3/2009 Sauter
7,502,455 B2 3/2009 Tadaaki
D602,037 S 10/2009 Nash
D603,283 S 11/2009 Colussi
7,620,459 B2 11/2009 Renner
D611,861 S 3/2010 Wiedeman
7,681,663 B2 3/2010 Cobern
7,726,255 B2 6/2010 Nakamichi
7,735,579 B2 6/2010 Gopalan et al.
7,748,474 B2 7/2010 Watkins
7,775,099 B2 8/2010 Bogath et al.
D629,410 S 12/2010 Ray
D631,808 S 2/2011 Yamazaki
7,913,773 B2 3/2011 Li et al.
D637,196 S 5/2011 Ray
D644,574 S 9/2011 Vardis
D650,300 S 12/2011 Fujioka
D654,415 S 2/2012 Mizuno
8,180,614 B2 5/2012 Pabon
8,210,283 B1 * 7/2012 Benson ..... E21B 45/00 175/61
8,214,188 B2 7/2012 Bailey
D667,434 S 9/2012 Phelan
D671,022 S 11/2012 Hoffman
D673,487 S 1/2013 Hanson
8,397,562 B2 3/2013 Wassell
D681,649 S 5/2013 Fletcher
D681,662 S 5/2013 Fletcher
D681,670 S 5/2013 Fletcher
8,443,764 B2 5/2013 Herstad
D683,645 S 6/2013 Bode
8,453,764 B2 6/2013 Turner
D687,043 S 7/2013 Matas
8,504,342 B2 8/2013 Bailey
8,525,690 B2 9/2013 Puro
8,577,487 B2 11/2013 Tarte
8,622,153 B2 1/2014 Mcloughlin
8,640,791 B2 2/2014 Turner
D701,226 S 3/2014 Jung
D701,869 S 4/2014 Matas
8,684,108 B2 4/2014 Turner
8,798,978 B2 8/2014 Ertas
8,817,024 B2 8/2014 Katoh
8,838,426 B2 9/2014 Aldred
8,977,523 B2 3/2015 Ertas
D729,839 S 5/2015 Bray
D731,545 S 6/2015 Lim
D744,494 S 12/2015 Roberts
D745,054 S 12/2015 Bray
9,249,654 B2 2/2016 Strachan
D755,240 S 5/2016 Cavander
D755,825 S 5/2016 Hwang
D778,303 S 2/2017 Deusing et al.
D786,913 S 5/2017 Dye
D788,154 S 5/2017 Kim et al.

(56) References Cited

U.S. PATENT DOCUMENTS

| | | | | |
|---|---|---|---|---|
| D788,792 | S | 6/2017 | Alessandri et al. | |
| D799,519 | S | 10/2017 | Broughton et al. | |
| D800,144 | S | 10/2017 | Anderson | |
| D800,163 | S | 10/2017 | Tsukahara | |
| D800,739 | S | 10/2017 | Sukumaran et al. | |
| D801,368 | S | 10/2017 | Broughton et al. | |
| D801,369 | S | 10/2017 | Chaudhri et al. | |
| D802,020 | S | 11/2017 | Kim et al. | |
| 2002/0011358 | A1 | 1/2002 | Wassell | |
| 2002/0088648 | A1 | 7/2002 | Krueger | |
| 2002/0120401 | A1 | 8/2002 | MacDonald | |
| 2003/0056608 | A1 | 3/2003 | Tadaaki | |
| 2003/0168257 | A1 | 9/2003 | Aldred | |
| 2004/0040746 | A1* | 3/2004 | Niedermayr | E21B 21/08 175/38 |
| 2004/0111507 | A1 | 6/2004 | Villado | |
| 2004/0256152 | A1 | 12/2004 | Dashevskiy | |
| 2005/0109097 | A1 | 5/2005 | Bogath | |
| 2005/0197777 | A1 | 9/2005 | Rodney | |
| 2006/0065440 | A1 | 3/2006 | Hutchinson | |
| 2006/0195265 | A1 | 8/2006 | Schen et al. | |
| 2006/0195307 | A1 | 8/2006 | Huang | |
| 2006/0215491 | A1 | 9/2006 | Hall | |
| 2007/0001830 | A1* | 1/2007 | Dagci | B60K 31/185 340/438 |
| 2007/0029112 | A1 | 2/2007 | Li | |
| 2007/0056771 | A1 | 3/2007 | Gopalan | |
| 2007/0061081 | A1 | 3/2007 | Moran | |
| 2007/0289778 | A1 | 12/2007 | Fincher | |
| 2008/0060849 | A1 | 3/2008 | Entchev et al. | |
| 2008/0238913 | A1 | 10/2008 | Katoh | |
| 2009/0073186 | A1 | 3/2009 | Caniglia | |
| 2009/0132458 | A1* | 5/2009 | Edwards | G06N 5/025 706/50 |
| 2010/0139977 | A1 | 6/2010 | Watkins | |
| 2010/0163306 | A1 | 7/2010 | Pabon | |
| 2010/0214121 | A1 | 8/2010 | Puro | |
| 2011/0024188 | A1 | 2/2011 | Wassell | |
| 2011/0029919 | A1 | 2/2011 | Woltkamp | |
| 2011/0186353 | A1 | 8/2011 | Turner | |
| 2011/0214878 | A1 | 9/2011 | Bailey | |
| 2011/0220410 | A1 | 9/2011 | Aldred | |
| 2012/0048621 | A1 | 3/2012 | Stewart | |
| 2012/0123757 | A1 | 5/2012 | Ertas | |
| 2012/0130693 | A1 | 5/2012 | Ertas | |
| 2012/0222900 | A1 | 9/2012 | Rodney | |
| 2012/0272186 | A1 | 10/2012 | Kraut | |
| 2013/0092438 | A1 | 4/2013 | Turner | |
| 2013/0098683 | A1 | 4/2013 | Turner | |
| 2014/0238662 | A1 | 8/2014 | Prieto | |
| 2014/0251688 | A1 | 9/2014 | Turner | |

FOREIGN PATENT DOCUMENTS

| | | | |
|---|---|---|---|
| CN | 101446191 | A | 6/2009 |
| CN | 102822752 | A | 12/2012 |
| CN | 104295233 | A | 12/2012 |
| CN | 202832481 | U | 3/2013 |
| DE | 3434565 | A1 | 3/1986 |
| GB | 2335450 | A1 | 9/1999 |
| GB | 2467626 | A | 8/2010 |
| GB | 2492906 | A | 1/2013 |
| GB | 2518282 | A | 3/2015 |
| WO | WO 97 046793 | A1 | 12/1997 |
| WO | WO 99 028594 | A1 | 6/1999 |
| WO | WO 2007 149866 | A2 | 12/2008 |
| WO | WO 2010 059295 | A1 | 5/2010 |
| WO | WO 2011 017626 | A1 | 2/2011 |
| WO | WO 2011 094689 | A1 | 8/2011 |
| WO | WO 2014 011171 | A1 | 1/2014 |

OTHER PUBLICATIONS

F. Dupriest & W. Koederitz, "Maximizing Drill Rates With Real-Time Surveillance of Mechanical Specific Energy," SPEAADC Drilling Conference, SPEAADC 92194 (2005).

W. Koederitz & J. Weis, A Real-Time Implementation of MSE, American Association of Drilling Engineers, AADE-05-NTCE-66 (2005).

Mihajlovic et al., Analysis of Friction-Induced Limit Cycling in an Experimental Drill, J. Dynamic Systems Measurement and Control, ASME, Dec. 2004, V. 126, pp. 709-720.

Abstract_Pushkar et al., Field Verification of Model-Derived Natural Frequencies of a Drill String, J. Energy Resour. Tech, Sep. 2002, V 124, Issue 3, 154.

Tech Power Controls Co Composite Catalog, Houston, Texas (2000).

DE 3434565 Mar. 27, 1986 Freisl (Abstract).

CN 102822752 A Dec. 12, 2012 Turner (Abstract).

CN 104295233 A Dec. 12, 2012 Wassell (Abstract).

Johancsik et al., "Torque and Drag in Directional Wells-Prediction and Measurement," SPE, Jun. 1984, pp. 987-992.

Samuel et al, "Tortuosity Factors for Highly Tortuous Wells: A Practical Approach," SPE-IADC Drilling Conference, SPE-IADC 92565 (2005).

International Patent Application No. PCT-US2011-023179: Notification of Transmittal of the International Search Report and the Written Opinion of the International Searching Authority dated Mar. 25, 2011.

Mazerov, "MWD/LWD Advances Push Telemetry Rates Higher, Expand Capabilities in Horizontal, HPHT, Deepwater Environments," Innovating While Drilling, Drilling Contractor Jul.-Aug. 2013, p. 63-73.

Mazerov, "MWD LWD Advances Push Telemetry Rates Higher, Expand Capabilities in Horizontal, HPHT, Deepwater Environments," Data Delivery Drilling Contractor_drillingcontractor.org_data-delivery-3-23869_Jul. 11, 2013_6 pgs.

APS Technology. Vibration Memory Sub (VMS™) Technical Data Sheet, 2009.

APS Technology, WellDrill™ Analytical Software for Downhole Drilling Equipment, 2009.

APS Technology, WellDrill Users Guide, v6, Feb. 2008.

APS Technology, SureShot™ Surface Systems & Components, 2009.

APS Technology, Vibration Memory Module (VMM™) Technical Data Sheet, 2009.

APS Technology, Advanced Systems for Drilling Performance, 2009.

Apostal et al, SPE 20458—"A Study to Determine the Effect of Damping on Finite-Element-Based, Forced-Frequency-Response Models for Bottom Hole Assembly Vibration Analysis", 1990, 65th Annual Technical Conference and Exhibition of the Society of Petroleum Engineers held in New Orleans, LA, Sep. 23-26, 1990, 537-550.

APS Technology, "Vibration Isolation Sub", (VMS™), APS Technology, Rev. 090804-vA, © 2009, 2 pages.

APS Technology, "Vibration Memory Module", (VMM™) Technical Data Sheet, Rev. 090805-vA.01, © 2009, 3 pages.

Pessier et al, "Quantifying Common Drilling Problems with Mechanical Specific Energy and a Bit-Specific Coefficient of Sliding Friction", SPE 24584, 1992, Presentation at the 67th Annual Technical Conference and Exhibition of the Society of Petroleum Engineers held in Washington DC, Oct. 4-7, 1992, pp. 373-388.

Chinese Patent Application No. 2014-10327955.8: First Office Action dated May 27, 2017, 11 pages (translation unavailable).

Simon, R., "Energy Balance in Rock Drilling", Society of Petroelum Engineers, Dec. 1963, 2 pages, (Abstract).

* cited by examiner

DRILLING SYSTEM FOR MONITORING AND DISPLAYING DRILLING PARAMETERS FOR A DRILLING OPERATION OF A DRILLING SYSTEM

CROSS REFERENCE TO RELATED APPLICATIONS

This application is a continuation of U.S. Design Application No. 29/460,812, filed Jul. 15, 2013, the entire contents of which are incorporated by reference in this application for all purposes.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present disclosure relates to a drilling system for forming a borehole in an earthen formation, and in particular to a drilling system and a method for monitoring drilling parameters for an underground drilling operation.

BACKGROUND

Underground drilling, such as gas, oil, or geothermal drilling, generally involves drilling a bore through a formation deep in the earth. Such bores are formed by connecting a drill bit to long sections of pipe, referred to as a "drill pipe," so as to form an assembly commonly referred to as a "drill string." The drill string extends from the surface to the bottom of the bore. The drill bit is rotated so that the drill bit advances into the earth, thereby forming the bore. In rotary drilling, the drill bit is rotated by rotating the drill string at the surface. A mud motor can be used to rotate the drill bit as is known. In general, optimal drilling is obtained when the rate of penetration ("ROP") of the drill bit into the formation is as high as possible while vibration of the drilling system is as low as possible. Rate of penetration is a function of a number of variables, including the rotational speed of the drill bit and the weight-on-bit ("WOB"). The drilling environment, and especially hard rock drilling, can induce substantial vibration and shock into the drill string, which has an adverse impact on drilling performance. Vibration is introduced by rotation of the drill bit, the motors used to rotate the drill bit, the pumping of drilling mud, and imbalance in the drill string, etc. Vibration can cause premature failure of the various components of the drill string, premature dulling of the drill bit, or may cause the catastrophic failures of drilling system components. Optimal drilling should account for the vibration of the drilling system and the impact such vibration can have on various operating parameters or drill string components. The drilling environment, as well as vibration of the drilling system during a drilling operation, can make it difficult for a drill rig operator to ensure that drilling parameters are operating as expected or optimally.

SUMMARY

An embodiment of the present disclosure is a drilling system for forming a borehole in an earthen formation. The drilling system can include a drill string configured to rotate so as to form the borehole in an earthen formation during a drilling operation. The drill string can operate according to one or one or more drilling parameters so as to form the borehole. The drilling system can include a plurality of sensors configured to obtain drilling data during the drilling operation, the drilling data being indicative of the one more drilling parameters, at least one of the plurality of sensors supported by the drill string. The drilling system can also include a computing device configured to determine a first plurality of operating ranges for the one or more drilling parameters of the drilling operation based on the drilling data obtained from the plurality of sensors. The first plurality of operating ranges can be based on a first duration of time operating the drill string during the drilling operation. The first plurality of operating ranges include at least one preferred operating range for each of the one or more drilling parameters and at least one less preferred operating range for each of the one or more drilling parameters. The computing device can also be configured to determine a second, updated plurality of operating ranges for the one or more drilling parameters. The second, updated plurality of operating ranges based on a second duration of time operating the drill string that is subsequent to the first duration of time, the second, updated plurality of operating ranges include at least one preferred operating range and at least one less preferred operating range for each of the one or more drilling parameters. The at least one preferred operating range of the second, updated plurality of operating ranges can be different than the at least one preferred operating range for the first plurality of operating ranges. The computing device can include a user interface, such as graphical user interface, that is configured to display on a computer display a visual indication of the first plurality of operating ranges for the one or more drilling parameters The user interface is configured to display subsequent to the first duration of time, a visual indication of the second, updated plurality of operating ranges for the one or more drilling parameters.

Another embodiment of the present disclosure is a computer implemented method, system and a non-transitory, tangible computer readable medium for monitoring and displaying one or more drilling parameters for a drill string operating to form a borehole in an earthen formation. The method includes determining, via a computer processor, a first plurality of operating ranges for the one or more drilling parameters for a drilling operation. The first plurality of operating ranges can be based on a first duration of time operating the drill string during the drilling operation. The first plurality of operating ranges include at least one preferred operating range for each of the one or more drilling parameters and at least one less preferred operating range for each of the one or more drilling parameters. In response to the step of determining the first plurality of operating ranges by the computer processor, the method can include displaying, via a graphical user interface on a computer display, a visual indication of the first plurality of operating ranges for the one or more drilling parameters. The method includes determining, via the computer processor, a second, updated plurality of operating ranges for the one or more drilling parameters. The second, updated plurality of operating ranges can be based on a second duration of time operating the drill string that is subsequent to the first duration of time. The second, updated plurality of operating ranges include at least one preferred operating range and at least one less preferred operating range for each of the one or more drilling parameters. The at least one preferred operating range of the second, updated plurality of operating ranges can be different than the at least one preferred operating range for the first plurality of operating ranges. In response to the step of determining the second, updated plurality of operating ranges, the method can display, via the graphical user interface on the computer display, the second, updated plurality of operating ranges the one or more drilling operation parameters.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments. It should be understood, however, that the application is not limited to the precise arrangements and instrumentalities shown. In the drawings.

DETAILED DESCRIPTION OF ILLUSTRATIVE EMBODIMENTS

Figure 1:
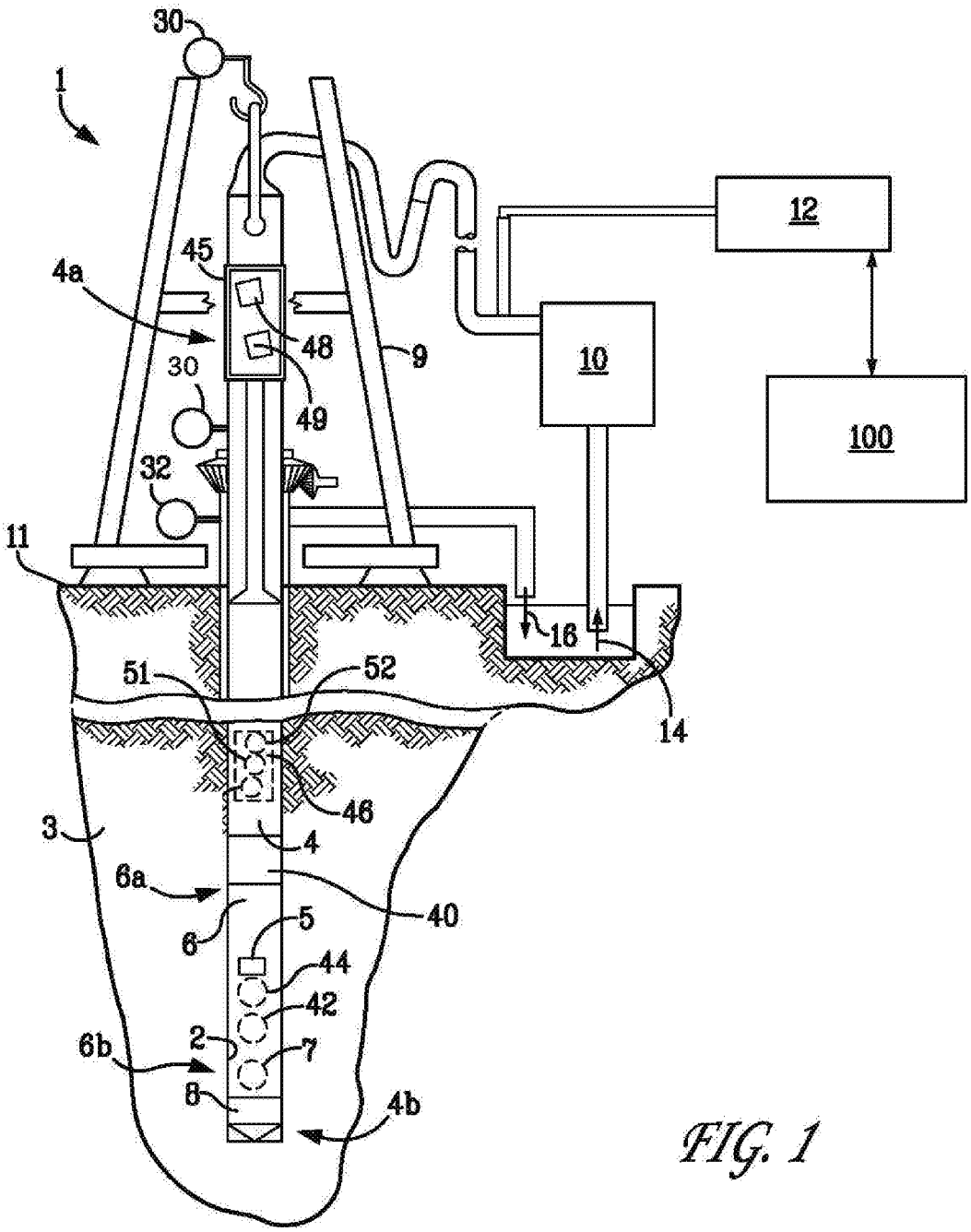
FIG. 1 is a schematic of a drilling system according to an embodiment of the present disclosure.

Referring to FIG. 1, a drilling system or drilling rig 1 is configured to drill a borehole 2 in an earthen formation 3 during a drilling operation. The drilling system 1 includes a drill string 4 for forming the borehole 2 in the earthen formation 3, and at least one computing device 100. The computing device 100 can include one or more software applications. The computing device 100 and the one or more software applications execute various methods for monitoring the drilling operation, controlling the drilling operation, and displaying information concerning the drilling operation as further detailed below. While the borehole 2 is illustrated as a vertical borehole, the systems and methods described herein can be used for directional drilling operation. For instance, the drill string 4 can be configured to form a borehole 2 in the earthen formation 3 a portion of which orientated along a direction that is transverse to an axis that is perpendicular to the surface 11 of the earthen formation 3.

Continuing with FIG. 1, the drilling system or rig 1 includes a derrick 9 supported by the earth surface 11. The derrick 9 supports the drill string 4. The drill string 4 has a top end 4*a*, a bottom end 4*b*, a top sub 45 disposed at the top end 4*a* of the drill string 4, and a bottomhole assembly 6 disposed at the bottom end 4*b* of the drill string 4. The drill string 4 can also include multiple sections of drill pipe (not shown) connected together to form the drill string. The bottomhole assembly 6 includes top end 6*a* and a bottom end 6*b*. A drill bit 8 is coupled to the distal end 6*b* of a bottomhole assembly 6. The drilling system 1 has a prime mover (not shown), such as a top drive or rotary table, configured to rotate the drill string 4 so as to control the rotational speed (RPM) of, and torque on, the drill bit 8. Rotation of the drill string 4 and drill bit 8 thus defines the borehole 2. As is conventional, a pump 10 is configured to pump a fluid 14, for instance drilling mud, downward through an internal passage in the drill string 4. After exiting at the drill bit 8, the returning drilling mud 16 flows upward to the surface 11 through an annular passage formed between the drill string 4 and the borehole 2 in the earthen formation 3. A mud motor 40, such as a helicoidal positive displacement pump or a "Moineau-type" pump, may be incorporated into the bottomhole assembly 6. The mud motor is driven by the flow of drilling mud 14 through the pump and around the drill string 4 in the annular passage described above. The mud motor can rotate the drill bit 8.

A drilling operation as used herein refers to one or more drill runs that define the borehole 2. For instance a drilling operation can include a first drill run for defining a vertical section of the borehole 2, a second drill run for defining a bent section of the borehole 2, and a third drill run for defining a horizontal section of the borehole 2. More or less than three drill runs are possible. For difficult drilling operations, as much as 10 to 15 drill runs may be completed to define the borehole 2 for hydrocarbon extraction purposes. It should be appreciated that one or more bottomhole assemblies can be used for each respective drill run. The systems, methods, software applications as described herein can be used to execute methods that monitor and control the drilling operation, as well as monitor and control the specific drilling runs in the drilling operation.

In the illustrated embodiment the computing device 100 is configured to cause the display of a visual indication of a plurality of operating ranges for each of the drilling parameters and to update the display as the drilling operation progresses. As will be further detailed bellow, the computing device 100 can cause the display of an operation set point or target for a particular drilling parameter, a preferred operating range, less preferred operating range, and a least preferred or critical operating range. Because the computing device 100 can cause the display of a visual indication of the ranges of operating parameters, a user can observe the effect of adjusting one drilling parameter on another drilling parameter during the course of the drilling operation.

Referring to FIG. 1, the drilling system 1 can include a plurality of sensors configured to measure drilling data during a drilling operation. Drilling data can include expected operating parameters, for instance the expected operating parameter for WOB, drill bit rotational speed RPM, and ROP for a given drilling plan. The sensors can be supported by the drill string downhole or positioned at the surface 11. In the illustrated embodiment, the drill string top sub 45 includes one or more sensors for measuring drilling data. For instance, the one or more sensors can be strain gauges 48 that measure the axial load (or hook load), bending load, and torsional load on the top sub 45. The top sub 45 sensors also include a triaxial accelerometer 49 that senses vibration at the top end 4*a* of the drill string 4.

Continuing with FIG. 1, the bottomhole assembly 6 can also include one or more sensors that are configured to measure one or more drilling parameters in the borehole. In addition, the bottomhole assembly 6 includes a vibration analysis system 46 configured to determine various vibration parameters based on the information regarding the drilling operation obtained from the sensors in the borehole. The vibration analysis module will be further detailed below. The bottomhole assembly sensors can be in the form of strain gauges, accelerometers and magnetometers. For instance, the bottomhole assembly 6 can include downhole strain gauges 7 that measure the WOB. A system for measuring WOB using downhole strain gauges is described in U.S. Pat. No. 6,547,016, entitled "Apparatus For Measuring Weight And Torque On A Drill Bit Operating In A Well," hereby incorporated by reference herein in its entirety. In addition, the strain gauges 7 can be configured to measure torque on bit ("TOB") and bending on bit ("BOB") as well as WOB. In alternative embodiments, the drill string can include a sub (not numbered) incorporating sensors for measuring WOB, TOB and BOB. Such a sub can be referred to as a "WTB sub."

Further, the bottomhole assembly sensors can also include at least one magnetometer 42. The magnetometer is configured to measure the instantaneous rotational speed of the drill bit 8, using, for example, the techniques in U.S. Pat. No. 7,681,663, entitled "Methods And Systems For Determining Angular Orientation Of A Drill String," hereby incorporated by reference herein in its entirety. The bottomhole assembly sensors can also include accelerometers 44, oriented along the x, y, and z axes (not shown) (typically with ±250 g range) that are configured to measure axial and lateral vibration. While accelerometer 44 is shown disposed on the bottomhole assembly 6, it should be appreciated that multiple accelerometers 44 can be installed at various locations along the drill string 4, such that axial and lateral vibration information at various locations along the drill string can be measured.

As noted above, the bottomhole assembly 6 includes a vibration analysis system 46. The vibration analysis system 46 is configured to receive data from the accelerometers 44 concerning axial, lateral, and torsional vibration of the drill string 4. Based on the data received from the accelerometers, the vibration analysis system 46 can determine the measured amplitude and frequency of axial vibration, and of lateral vibration due to forward and backward whirl, at the location of the accelerometers on the drill string 4. The measured amplitude and frequency of axial and lateral vibration can be referred to as measured vibration information. The measured vibration information can also be transmitted to the surface 11 and processed by the computing device 100. The vibration analysis system 46 can also receive data from the magnetometer 42 concerning the instantaneous rotational speed of the drill string at the magnetometer 42 location. The vibration analysis system 46 then determines the amplitude and frequency of torsional vibration due to stick-slip. The measured frequency and amplitude of the actual torsional vibration is determined by calculating the difference between and maximum and minimum instantaneous rotational speed of the drill string over a given period of time. Thus, the measured vibration information can also include measured torsional vibration.

The bottomhole assembly sensors can also include at least a first and second pressure sensors 51 and 52 that measure the pressure of the drilling mud flowing through drilling system components in the borehole 2. For instance, the first and second sensors 51 and 52 measure pressure of the drilling mud flowing through the drill string 4 (in a downhole direction), and the pressure of the drilling mud flowing through the annular gap between the borehole wall and the drill string 4 in an uphole direction, respectively. Differential pressure is referred to as the difference in pressure between the drilling mud flowing in the downhole direction and the drilling mud flowing in the up-hole direction. Pressure information can be transmitted to the computing device 100.

Further, the drilling system 1 can also include one or more sensors disposed at the surface, for instance on the derrick 9. For instance, the drilling system can include a hook load sensor 30 for determining WOB and an additional sensor 32 for sensing drill string rotational speed of the drill string 4. The hook load sensor 30 measures the hanging weight of the drill string, for example, by measuring the tension in a draw works cable (not numbered) using a strain gauge. The cable is run through three supports and the supports put a known lateral displacement on the cable. The strain gauge measures the amount of lateral strain due to the tension in the cable, which is then used to calculate the axial load and WOB.

The drilling system 1 can also include a drilling data acquisition system 12 that is in electronic communication with the computing device 100. The drilling data acquisition system 12 is configured to receive, process and store data that has been obtained from the various downhole and surface sensors described above. Accordingly, various systems and methods for transmitting can be used to transmit data between drill string components and the drilling data acquisition system 12. For instance, in a wired pipe implementation, the data from the bottomhole assembly sensors is transmitted to the top sub 45. The data from the top sub 45 sensors, as well as data from the bottomhole assembly sensors in a wired pipe system, can be transmitted to the drilling data acquisition system 12 and/or computing device 100 using wireless telemetry. One such method for wireless telemetry is disclosed in U.S. application Ser. No. 12/389,950, filed Feb. 20, 2009, entitled "Synchronized Telemetry From A Rotating Element," hereby incorporated by reference in its entirety. In addition, the drilling system 1 can include a mud pulse telemetry system. For instance, a mud pulser 5 can be incorporated into the bottomhole assembly 6. The mud pulse telemetry system encodes data from downhole equipment, such as vibration information from the vibration analysis system 46 and, using the pulser 5, transmits the coded pulses to the surface 11. Further, drilling data can be transmitted to the surface using other means such as acoustic or electromagnetic transmission.

Figure 2A:
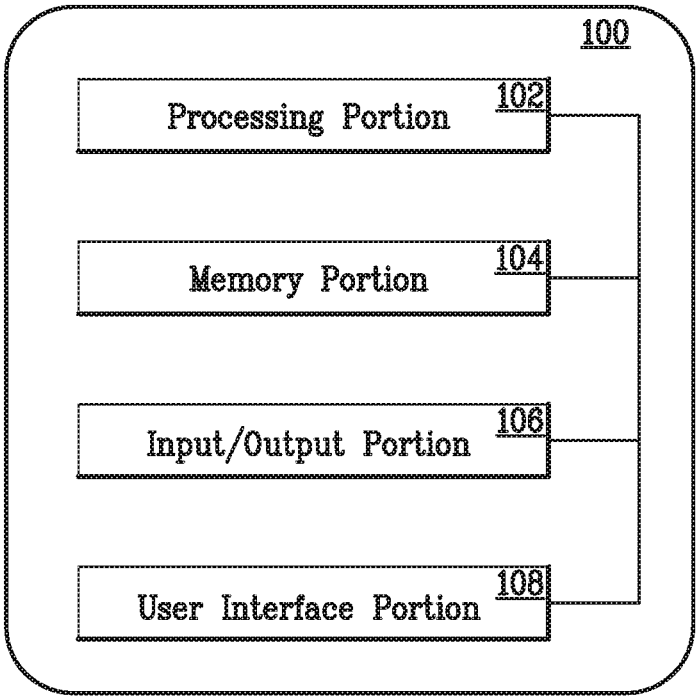
FIG. 2A is a block diagram of a computing device used in the drilling system shown in FIG. 1.

Referring to FIG. 2A, any suitable computing device 100 may be configured to host a software application for monitoring, controlling and predicting drilling operation information as described herein. It will be understood that the computing device 100 can include any appropriate device, examples of which include a desktop computing device, a server computing device, or a portable computing device, such as a laptop, tablet or smart phone. In an exemplary configuration illustrated in FIG. 2A, the computing device 100 includes a processing portion 102, a memory portion 104, an input/output portion 106, and a user interface (UI) portion 108. It is emphasized that the block diagram depiction of computing device 100 is exemplary and not intended to imply a specific implementation and/or configuration. The processing portion 102, memory portion 104, input/output portion 106 and user interface portion 108 can be coupled together to allow communications therebetween. As should be appreciated, any of the above components may be distributed across one or more separate devices and/or locations. For instance, any one of the processing portion 102, memory portion 104, input/output portion 106 and user interface portion 108 can be in electronic communication with the drilling data acquisition system 12, which as noted above can be a computing device similar to computing device 100 as described herein. Further, any one of the processing portion 102, memory portion 104, input/output portion 106 and user interface portion 108 can be capable of receiving drill data from the sensors and/or the vibration analysis system 46 disposed on the drill string 4.

In various embodiments, the input/output portion 106 includes a receiver of the computing device 100, a transmitter of the computing device 100, or an electronic connector for wired connection, or a combination thereof. The input/output portion 106 is capable of receiving and/or providing information pertaining to communication with a network such as, for example, the Internet. As should be appreciated, transmit and receive functionality may also be provided by one or more devices external to the computing device 100. For instance, the input/output portion 106 can be in electronic communication with the drilling data acquisition system 12 and/or one or more sensors disposed on the bottomhole assembly 6 downhole.

Depending upon the exact configuration and type of processor, the memory portion 104 can be volatile (such as some types of RAM), non-volatile (such as ROM, flash memory, etc.), or a combination thereof. The computing device 100 can include additional storage (e.g., removable storage and/or non-removable storage) including, but not limited to, tape, flash memory, smart cards, CD-ROM, digital versatile discs (DVD) or other optical storage, magnetic cassettes, magnetic tape, magnetic disk storage or other magnetic storage devices, universal serial bus (USB) compatible memory, or any other medium which can be used to store information and which can be accessed by the computing device 100.

The computing device 100 also can contain the user interface portion 108, which can include an input device 110 and/or display 112 (input device 110 and display 112 not shown), that allows a user to communicate with the computing device 100. The user interface 108 can include inputs that provide the ability to control the computing device 100, via, for example, buttons, soft keys, a mouse, voice actuated controls, a touch screen, movement of the computing device 100, visual cues (e.g., moving a hand in front of a camera on the computing device 100), or the like. The user interface 108 can provide outputs, via a graphical user interface, including visual information, such as the visual indication of the plurality of operating ranges for one or more drilling parameters via the display 112. Other outputs can include audio information (e.g., via speaker), mechanically (e.g., via a vibrating mechanism), or a combination thereof. In various configurations, the user interface 108 can include a display, a touch screen, a keyboard, a mouse, an accelerometer, a motion detector, a speaker, a microphone, a camera, or any combination thereof. The user interface 108 can further include any suitable device for inputting biometric information, such as, for example, fingerprint information, retinal information, voice information, and/or facial characteristic information, for instance, so as to require specific biometric information for access the computing device 100.

Figure 2B:
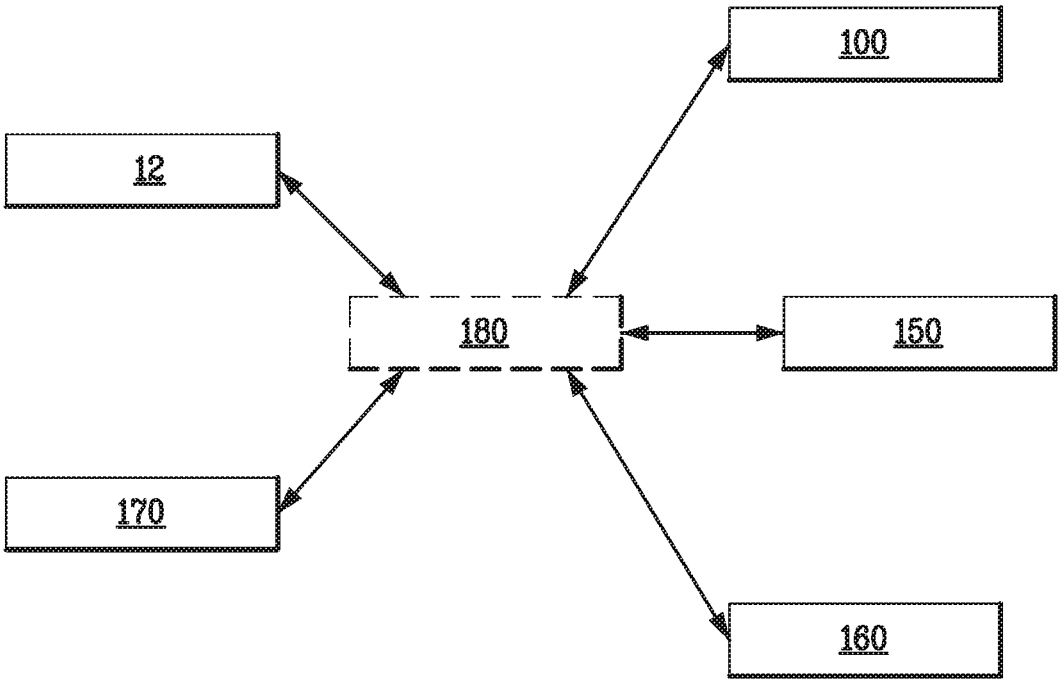
FIG. 2B is a block diagram illustrating a network of one or more computing devices of the drilling system shown in FIG. 1.

Referring to FIG. 2B, an exemplary and suitable communication architecture is shown that can facilitate monitoring a drilling operation of the drilling system 1. Such an exemplary architecture can include one or more computing devices 100, 150 and 160 each of which can be in electronic communication with a database 170 and a drilling data acquisition system 12 via common communications network 180. The database 170, though schematically represented separate from the computing device 100 could also be a component of the memory portion 104 of the computing device 100. It should be appreciated that numerous suitable alternative communication architectures are envisioned. Once the drilling control and monitoring application has been installed onto the computing device 100, such as described above, it can transfer information between other computing devices on the common network 180, such as, for example, the Internet. For instance, in one configuration a user 24 may transmit, or cause the transmission of information via the network 180 regarding one or more drilling parameters to the computing device 150 of a supplier of the bottomhole assembly 6, or alternatively to computing device 160 of another third party 26 (e.g., a drilling system owner) via the network 180. The third party 26 can view, via a display, the plurality of operating ranges for the one or more drilling parameters as described herein.

The computing device 100 depicted in FIG. 2B may be operated in whole or in part by, for example, a rig operator at the drill site, a drill site owner, a drilling company, and/or any manufacturer or supplier of drilling system components, or other service provider, such as a third party providing drill string design services. As should be appreciated, each of the parties set forth above and/or other relevant parties may operate any number of respective computers and may communicate internally and externally using any number of networks including, for example, wide area networks (WAN's) such as the Internet or local area networks (LAN's). Database 170 may be used, for example, to store data regarding one or more drilling parameters, the plurality of operating ranges from a previous drill run and/or a current drill run, and data concerning models for the drill string components.

Figure 3:
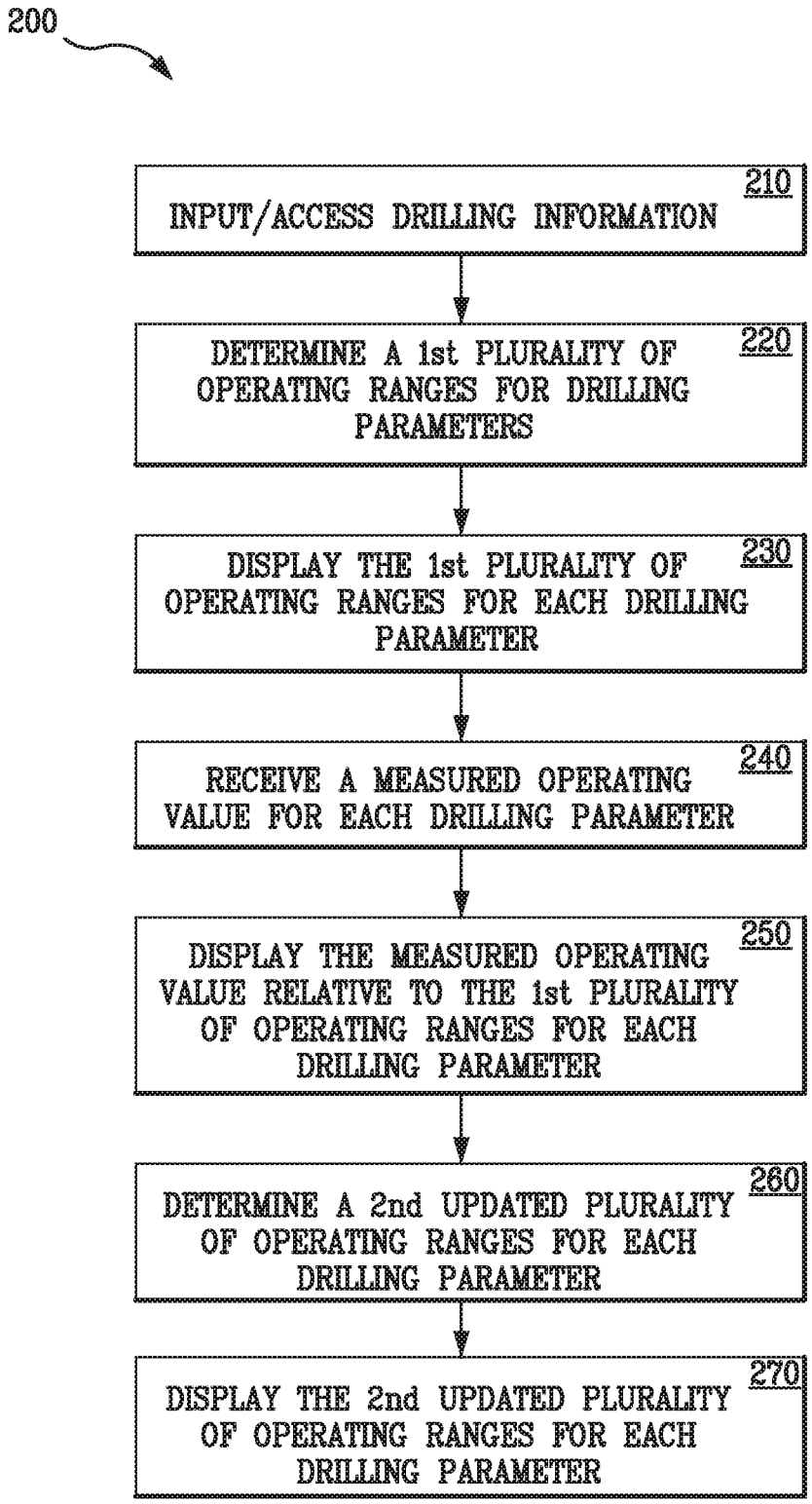
FIG. 3 is a process flow diagram illustrating a method for monitoring and displaying drilling parameters for a drilling operation of the drilling system shown in FIG. 1.

Referring to FIG. 3, the drilling system 1, such as the computing device, hosts a software application that causes the processor 102 to execute a method 200 to obtain, determine and display the a plurality of operating ranges for the drilling parameters, including at least an optimized operating parameter. In block 210, the software application can obtain drilling information concerning one or more drilling parameters. For instance, the software application can access drilling information from one or more computer readable storage medium having stored therein drilling information. Further, as should be appreciated, the software application can cause the user interface to display on a computer display one or more fields for drilling operation information entry. As such, the software application can receive drilling information.

In block 220, the software application can determine via a processor a first plurality of operating ranges for one or more drilling parameters. The first plurality of operating ranges can be based on a first duration, or moment, of time operating the drill string 4 during the drilling operation. The determination of the first plurality of operating ranges can be based on drilling information obtained in step 210, as well as the actual and measured drilling information obtained during a drilling operation.

The one or more drilling parameters can also include a first, or control set of drilling parameters that are typically controllable by the rig operator. The control set of drilling parameters are used to assist in controlling the drilling operation and can be the drilling parameters that can be optimized. Optimization is discussed below. The control set of drilling parameters include, but are not limited to, rate of penetration (ROP), weight-on-bit (WOB), mud flow rate, drill bit rotational speed and differential pressure. In addition, the drilling parameters can include a second, or process dependent, set of drilling parameters, the values of which are the result of the drilling operation. The process dependent set of drilling parameters can include torque (kft-lb), rotary speed (RPM), motor speed (RPM), mechanical specific energy (ksi), MSE scatter (ksi), slope of the mechanical specific energy (ksi), pressure (ksi), whirl, bit-bounce, and stick-slip. It should be appreciated that any system of units can be used during the display of the drilling parameters. The process dependent drilling parameters are measured or calculated values and are not necessarily optimizable, as noted above. The software application is configured to distinguish between control drilling parameters and process dependent drilling parameters and to display the applicable operating ranges accordingly. For instance, the control set of drilling parameters can include optimal operating ranges as well as a preferred operating range. Each drilling parameter, including the control set and process dependent drilling parameters, can be measured, calculated and/or predicted according to the methods and systems described in U.S. Pat. No. 8,453,764, entitled SYSTEM AND METHOD FOR MONITORING AND CONTROLLING UNDERGROUND DRILLING (the '764 patent), the entirety of which is herein incorporated by reference. In addition, in an embodiment of the present disclosure, the present disclosure can also include accessing and using data indicative of a pre-defined model of the drill string and desired drilling parameters, for instance as described in the '764 patent.

Returning to block 220, the software application can define the endpoints for each operating range (see endpoints 460, 462 . . . 474 in FIGS. 5A-9B), such that the user interface can generate a display that illustrates the association that one operating range has to another operating range. Details concerning how the endpoints are determined are discussed below.

The plurality of operating ranges determined in block 220 can include 1) at least one preferred operating range for each drilling parameter, and 2) at least one less preferred operating range for each drilling parameter. The preferred operating ranges can have more than one (a plurality) of preferred operating ranges. For instance, the preferred operating range can include an optimized operating range and a normal operating range. The less preferred operating ranges can have more than one (a plurality) of less preferred operating ranges. The less preferred operating range can include at least one of a high operating range, a severe operating range, and a critical operating range. Accordingly, the plurality of operating ranges can be referred to as a first, second, third . . . etc., operating range. For instance, a first operating range refers to the optimized operating range, the second operating range refers to the normal operating range, the third operating range refers to the high operating range, the fourth operating range refers to the severe operating range, and the fifth operating range refers to the critical operating range. Each drilling parameter can include one or more of the aforementioned operating ranges. In some instances, certain drilling parameters may include the optimized operating range as further detailed below.

The optimized operating range 420 (FIG. 5A) is the range of operating values for a particular drilling parameter that can yield the highest ROP for a given drilling plan. The drilling plan can account for the desired ROP and expected wear and tear on the drill string components. Further, the determination of the optimized operating range can take into account the desired and actual operating values for several drilling parameters, surface data and downhole data obtained by the sensors during a drilling operation. For instance, the optimized operating range takes into account ROP, rotary speed, torque, WOB, flow rate, differential pressure, MSE, and lateral, axial and torsional vibration data, as further detailed below. Thus, according to an exemplary embodiment, the optimized operating range can be the range of operating values for a particular drilling parameter that can yield the highest ROP and the lowest wear and tear on the drill string components. The drilling plan can thus include an assessment of drill string component wear and tear. Expected wear and tear can be based on the expected or the predicted level of vibration encountered during a drilling run and a lost performance analysis of a drill string component at the level of predicted vibration. Vibration data and lost performance analysis, which can indicate wear and tear of drill string components, can be determined according to the systems and methods disclosed in U.S. Pat. No. 8,453,764, herein incorporated by reference in its entirety.

Continuing with FIG. 3, in accordance with the exemplary embodiment in block 220, the software application can determine the endpoints for the optimized operating range. The endpoint determination can be based upon: 1) data stored in the database 170 or memory portion 104 obtained during an optimization drilling operation (further discussed below), 2) data obtained during a previous drill run and stored in database 170 or memory portion 104, or 3) data obtained real-time during a current drill run that may be stored in database 170 and/or memory portion 104. After the optimization drilling operation (or during a drill run), the software application can determine, for instance, and can cause the display of WOB as a function of rotary speed, flow rate, and/or differential pressure that shows how MSE, and lateral, axial and torsional vibration data varies at each given drilling parameter set point. See FIG. 4B which shows a display 350 that include exemplary graphs 352*a* through 352*h* for process depending drilling parameters for a drilling operation. It should be appreciated that 1) rotary speed could be displayed as a function of WOB, flow rate and differential pressure, and 2) flow rate could be displayed as a function of rotary speed, WOB and differential pressure, etc. The software application can thus determine the optimized operating range for WOB, rotary speed, flow rate, differential pressure, by taking into account how WOB, rotary speed, flow rate, differential pressure relate to MSE, and lateral, axial and torsional vibration data obtained during a drilling operation. While the determination of the optimized operating range endpoints is discussed below with reference to the optimization drilling operation, it should be appreciated that the software application is configured to cause the display of optimized operation ranges during a drilling run.

In an accordance with the exemplary embodiment for an optimization drilling operation, set point values 415 (FIGS. 4C-9B) for drilling parameters, such as rotary speed, WOB, flow rate and differential pressure, can be selected for the optimization drilling operation. The optimization drilling operation is thus one or more drilling optimization runs that are used to obtain information needed to determine the endpoints of the optimized operating range. For instance, the optimized drilling operation can be initiated and rotary speed, WOB, flow rate and differential pressure can be varied. Changes to the drilling operation can be measured to account for the variance of rotary speed, WOB, flow rate and differential pressures. In particular, the optimized drilling operation can proceed according to an optimization matrix. The optimization matrix can define two drilling parameters, for instance WOB and rotary speed, that are varied during an optimized drill run. For instance, drilling set points of rotary speed equal to 60 rpm and WOB equal to 20 k lb WOB can be selected. The optimization matrix varies the values for rotary speed and WOB by a given amount, such as plus or minus 5, 10, 20, etc., for each respective drilling parameter. In an exemplary embodiment, the selected rotary speeds could be 50, 60 and 70 rpm and the selected values WOB may be 20 k-lb, 25 k-lb. and 30 k-lb. Others matrices may include rotary speeds of 50, 60 and 70 rpm and the selected values for flow rated values could be 525, 550 and 575. It should be appreciated that other methods, such as design of experiment tools, can be used to determine and/or develop the drilling parameter set points for the optimization drilling operation. An optimization drill run is then commenced for each drilling parameter combination defined in the optimization matrix discussed above. Each optimized drill run can proceed at a predetermined duration of time, for instance a period of time that is sufficient to measure and transmit relevant data to the computing device 100. It should be appreciated that data acquisition times can vary based on the particular sensors and control systems used in the drilling system and the type of data that is being obtained. For example, when only vibration data is being sent to the computing device for optimized operating range determination, each optimized drilling run will proceed for at least the length of time it takes for the sensors in the drill string measure and transmit the vibration data to the drilling data acquisition system 12 and/or computing device 100. Each optimized drilling run will then proceed for at least that specific duration of time. If other data is transmitted with the vibration data, the optimized drill run can be proceed for a longer duration. Data from each optimized drilling run can be stored in database 170 or memory portion 104.

The software application can determine endpoints based on the maximum value for ROP that yields the lowest expected wear on drill string components, taking into account the vibration data obtained during the drilling optimization operation, using the systems and methods disclosed in U.S. Pat. No. 8,453,764 noted above. In addition, the software application can also allow the user to input information for endpoint optimization determination. For instance, the user can limit the specific data used to conduct the optimization analysis. The graphical user interface is configured to cause the display of log plots for the data obtained measured over time. The user can then select a range of time over the optimization drilling operation that is used to perform the optimization analysis. It should be appreciated that other methods can be used to determine the optimal operation range for drilling parameter so long as the optimal operation takes into account drilling information that includes vibration information and expected drill string component useful life. In other words, the optimal operation ranges can be calculated as discussed above, or can be based on information concerning the drilling string components and predicted vibration information.

The normal operating range 430 (FIG. 5A) and optimized operating range 420 can overlap. For instance, the optimized operating range 420 can fall within a portion of the preferred or normal operating range 430. The high operating range 440 (FIG. 5A) is defined as when the drilling parameter is operating a high level. The severe operating range 451 (FIG. 5A) is a severe operation level. The critical operating range 450 (FIG. 5A) is defined as an operating range that will lead to catastrophic damage or system failure should the operation continue at that specific range.

Due to the complex nature of the drilling environment, such as pressure, axial, lateral and torsional vibrations of drill string, earthen formation characteristics, and the drill string design and characteristics, the relationship between desired drilling performance and the values for a specific drilling parameter may not be linear for each drilling parameter. In other words, there can be normal, high, severe, and critical operating ranges for each drilling parameter that are independent of a linear increase in the scale of a given drilling parameter. It has been found that certain drilling parameters may have normal and optimized operating ranges that are bounded, or fall between, less preferred operating ranges (see for instance FIGS. 5A and 5B). Each drilling parameter can thus have, and can be displayed as having, more than one (for instance a plurality) of normal operating ranges, more than one (for instance a plurality) of high operating ranges, more than one (for instance a plurality) of severe operating ranges, and more than one (for instance a plurality) of critical operating ranges. The computing device 100 running the software application can determine the plurality of operating ranges for each drilling parameter as noted above in block 220, the extent and the number of specific operating ranges for each drilling parameter, and display those ranges along the scale of the drilling parameter. The user can then visualize the complex relationship between the various drilling parameters, as the drilling parameters are measured during a drilling operation. The operating ranges can be updated as drilling conditions change or the drilling operation transitions from one drill run to the another drill run.

Figure 5A:
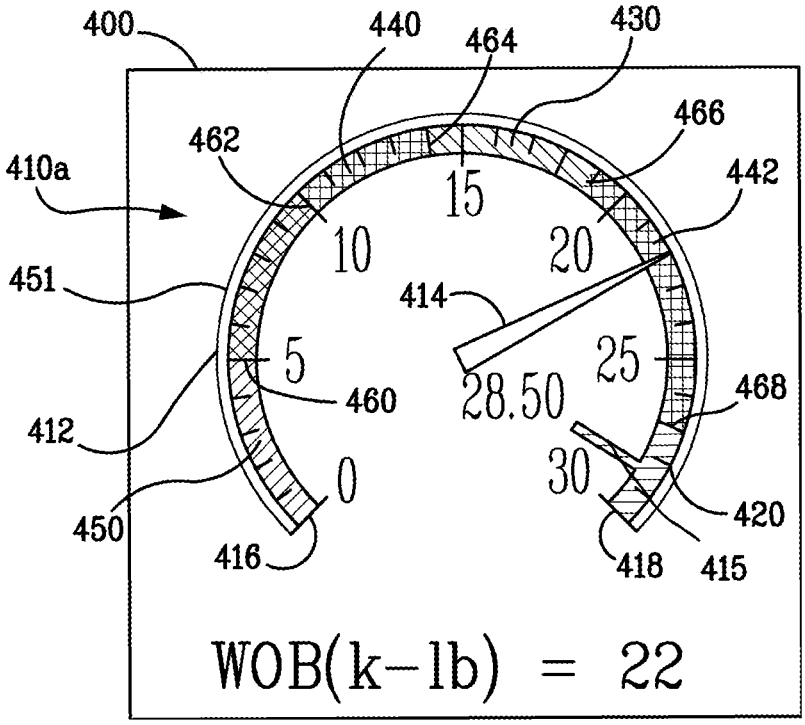
FIGS. 5A and 5B are displays illustrating a portion of the user interface shown in FIGS. 4C and 4D, showing a first plurality of operating ranges for weight-on-bit (WOB) and a second, updated plurality of operating ranges for WOB, respectively.
Figure 5B:
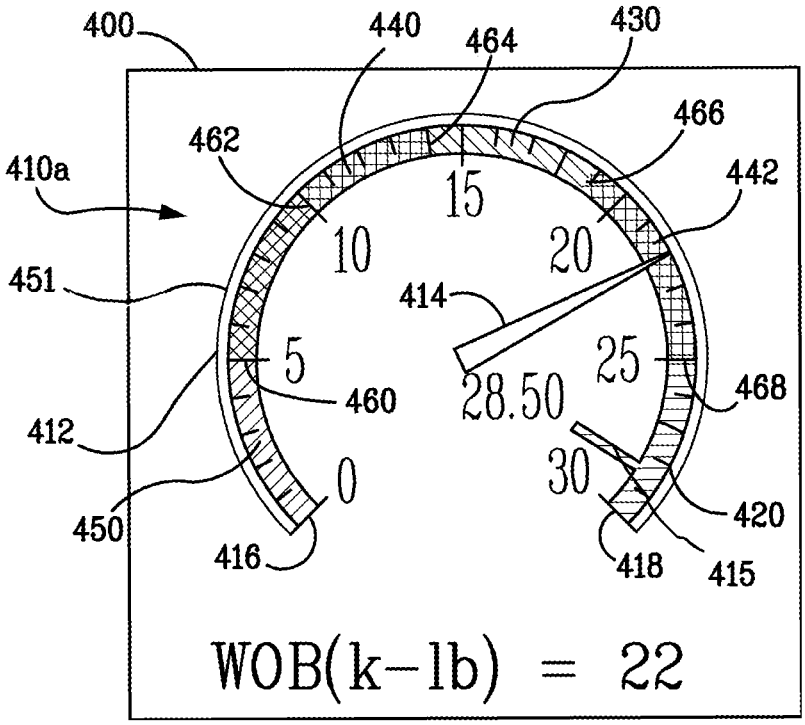

Referring again to FIG. 3, in block 230, the software application can cause the user interface to display a visual indication of the first plurality of operating ranges for the one or more drilling operation parameters, for instance on a display screen of the computing device 100. In block 230, the software application can cause the processor 102 to initiate instructions to the user interface to display the visual indication of the plurality of operating ranges in response to the step of determining the first plurality of operating ranges in block 230. In block 230, the software application can also cause the user interface to arrange each preferred operating range relative to each of the less preferred operating ranges so as to visually indicate whether a preferred operating range is disposed between two less preferred operating ranges, for instance as shown in FIGS. 5A and 5B. Further, the visual indication of the operating ranges can be in different colors (FIGS. 5A-9B). For instance, the optimized operating range can be represented in blue (see band 420 in FIGS. 5A-9B) and the normal operating range can be represented in green (see band 430 in FIGS. 5A-9B). The high operating range can be represented in yellow (see band 440 in FIGS. 5A-9B) and the severe operating range can be represented in orange (see band 451 in FIGS. 5A-9B). The critical operating range can be represented in red (see band 450 in FIGS. 5A-9B). It should be appreciated that any color or visual cue can be used to denote different operation information. Further, the drawings are illustrated using the standard representation for different colors according to U.S. Patent and Trademark Office regulations, while the description herein refers to specific colors for clarity of description In block 240, the software application can receive data indicative of the actual operating value of the drilling parameter. For instance, as noted above, one or more of the sensors can obtain data that is indicative of the operating values of drill string components during the drilling operation. While in some instances sensors may measure a physical response of the drill string to the drilling operation, e.g., instantaneous rotational speed, processors disposed in the bottomhole assembly 6 can calculate the drilling parameter for the measured physical response. The actual operating value for a drilling parameter can be transmitted to the computing device 100 at the surface 11 and stored in the memory portion 104 of the computing device 100 for access by the software application. Alternatively or in addition, the physical response data can be transmitted to the computing device 100 at the surface and the actual operating value for the desired drilling parameter can be calculated at the surface. Further, the software application can receive the physical response of the drill string and calculate the actual operating value for the drilling parameter. Data indicative of the actual operating parameter can be transmitted to the surface computing devices via the communications systems discussed above.

In block 250, in response to receiving data indicative of the actual operating value for the drilling operation, or drill run, the software application can cause the display of the actual operating value for each of the drilling parameters relative to the first plurality of operating ranges. The software application may access or receive actual operating data, via the communications system discussed above, prior to the display of such data. The methods described here can also cause the actual operating value of each drilling parameter to be continuously updated as the drilling operation continues.

In block 260, the method can include a step of determining, via the computer processor, a second, updated plurality of operating ranges for the one or more drilling parameters. As further detailed below, the second, updated plurality of operating ranges may be based on a second moment or duration of time operating the drill string. The second, updated plurality of operating ranges includes at least the preferred operating range for each of the one or more drilling parameters and the less preferred operating range for each of the one or more drilling parameters.

In block 270, the software application can cause the user interface to display the second, updated plurality of operating ranges for the one or more drilling parameters. The user interface can display the second, updated plurality of operating ranges in response to the step of determining the second, updated plurality of operating ranges in block 260.

It should be appreciated that the steps illustrated in blocks 210-260 can be repeated any number of times during a drilling operation. For instance, the method can include the step of determining a third, updated plurality of operating ranges for the one or more drilling parameters. The third, updated plurality of operating ranges can be based on a third duration of time operating the drill string that is subsequent to the first and second durations of time. In response to the step of determining the third, updated plurality of operating ranges, the software application can display, via the user interface, the third, updated plurality of operating ranges for the one or more drilling operation parameters. Further, the method can be run continuously for a single drill run in a drilling operation, or for multiple drilling runs during a drilling operation. In addition, it should be appreciated that the determination of the third plurality of operating ranges, and the associated optimized range for the drilling parameters, can be associated with a respective first and second operating ranges for the drilling operation.

The computing device 100, and in particular the graphical user interface, can cause one or more authentication displays (not shown) to be presented to the user. Upon successful authentication, for instance, entry of appropriate user identifiers and passwords, the user interface can generate display 300 as shown FIG. 4A. The display 300 includes a plurality of drilling system component data entry arrays. Each array includes a plurality of data entry fields associated with that respective drilling system component. For instance, the display 300 includes drill bit or bit array 302 that includes data entry fields 320 for maximum WOB, and max/min drilling mud flow rates. Motor array 304 includes drilling parameters associated with the motor operation, for instance operation of the motor that rotates the drilling sting. Motor array 304 can include, for instance, revolutions per volume of mud, rotor to stator ratio, max./min. flow rates, WOB, full rated differential pressure, full rated torque, maximum differential pressure, and stall torque. Measure-While-Drilling (MWD) tool array 306 can include data entry fields 326 for drilling parameters associated with the MWD tool, for instance, max./min. allowable flow rates. The display 300 can also include a rotary steerable system (RSS) array 310. As should be appreciated, the RSS array is used when the drilling string includes a rotary steerable system for directional drilling. The RSS array includes data fields 328 for drilling parameters associated with the RSS tool. The display can include additional array 308, denoted as "other" in the illustrated embodiment, that includes data entry fields 322 for other components that might be used in a drilling operation. Further, a hole cleaning array 312 can include a data entry field 324 for the minimum flow rate. It should be appreciated that the display 300 can be arranged in other configurations and could include other drilling component arrays as needed.

Further, the display 300 includes features that allow prior drilling operation information to be automatically populated into the data entry fields. For instance, the display 300 can include a "Bit Run" field 318 that can include a listing of each particular drill run or bit run performed by a drilling operation. If a user selects a previous bit run, by selecting "Bit Run #1", for example, the software application causes the user interface to populate the various data entry fields with drilling data from the selected bit run. The user can input "cancel" at field 316 and the data fields will be depopulated. Alternatively, the user can enter drilling information and create a new "bit run".

Figure 4A:
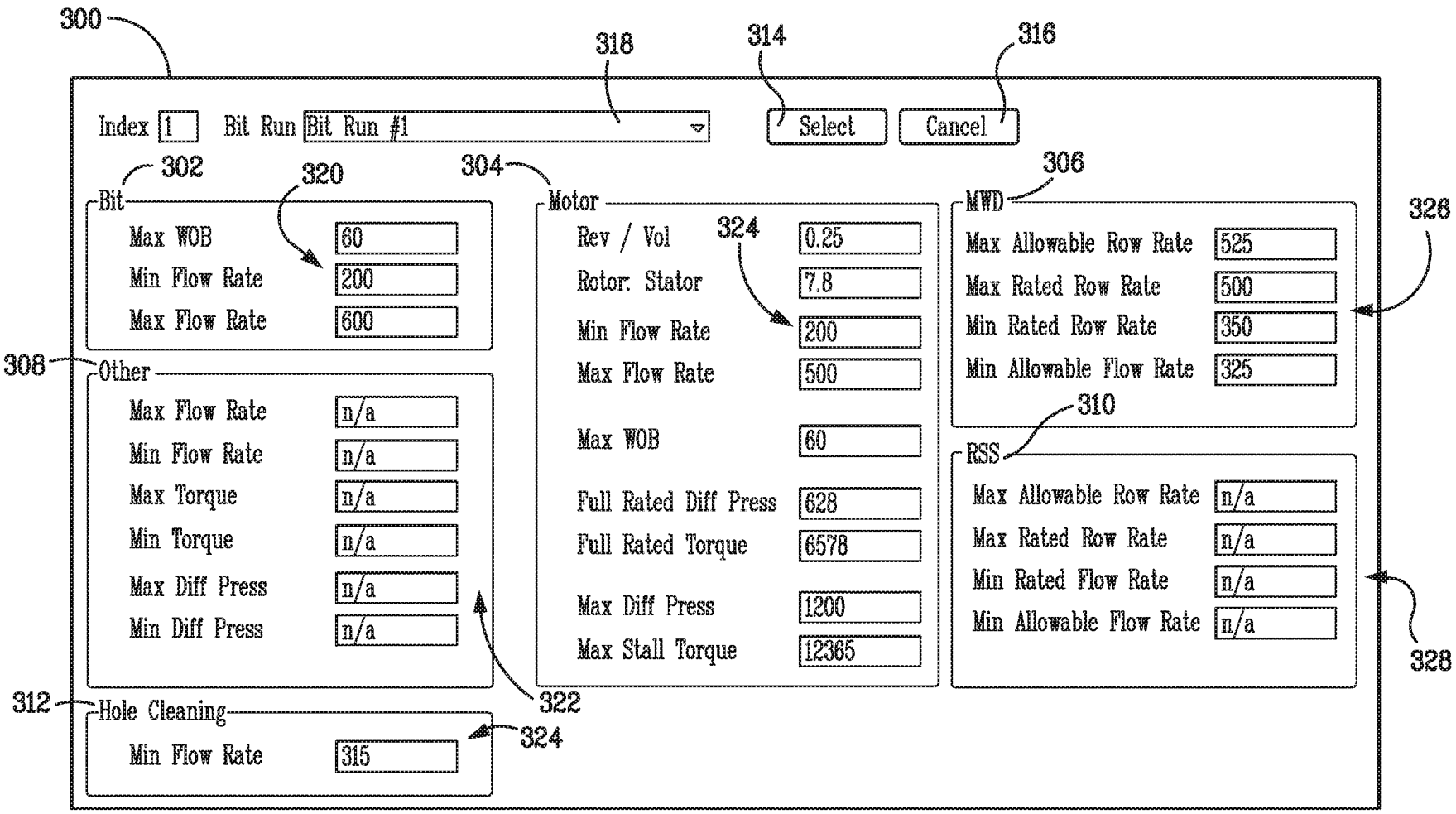
FIG. 4A is a display of a user interface associated with the computing device shown in FIG. 2A; illustrating various inputs for the drilling operation of the drilling system shown in FIG. 1.

The user can input the various desired parameters for each drilling parameter in the data fields for each drilling component array 302, 304, 306, 308, 310 and 312. For instance, as shown in FIG. 4A, the user can input values for each drilling parameter that the user would like to optimize or have displayed. Alternatively, the data fields can be populated automatically as noted above. If the user does not want to see operating ranges for a particular drilling system component, then the user can enter "zero" or "n/a" in each data field for the specific drilling component array. Next, the user would click on "select" field 314. The software application, based on the inputs and additional drilling information described above, would determine the specific operating ranges for each drilling parameter. When the optimization calculations are complete, the software application causes the user interface to generate a display 400 that includes digital dials showing, for instance in different colors, the operating ranges for each selected drilling parameter. For instance, the display 400 shown in FIG. 4C includes digital dials for each drilling parameter, whereas the display 400 shown in FIG. 4D includes digital dials for only a few drilling parameters, as will be further detailed below. As the drilling operation continues, the software application can also illustrate the actual operating range for the drilling parameter. Over some period of time, the one or more operating ranges can be automatically updated based on drilling information obtained using surface or downhole sensors.

Figure 4B:
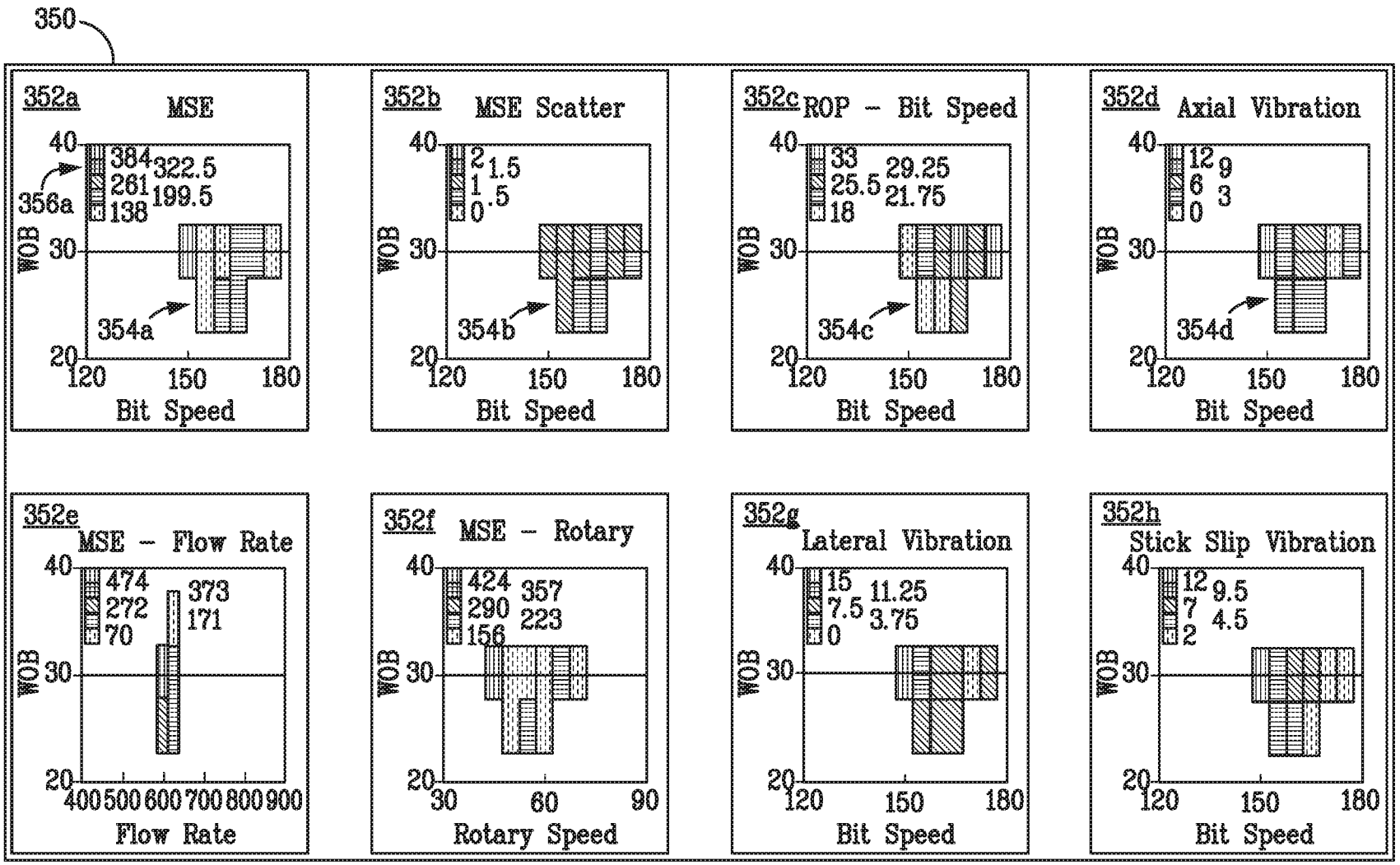
FIG. 4B is a display of a user interface associated with the computing device shown in FIG. 2A, illustrating how one or more drilling parameters may correlate to exemplary drilling data for a drilling operation of the drilling system shown in FIG. 1.

Turning to FIG. 4B, the computing device 100, via the software application, causes the user interface to display the display 350 graph showing drilling information for a range of drilling parameter values. As discussed above, the display 350 can be based on a drilling optimization operation or an actual or real-time drilling operation. The display 350 can include visual indications, for instance, graphs 352*a* through 352*h*, of values for process dependent drilling parameters as a function of WOB, rotary speed, bit speed, flow rate and/or differential pressure (not shown). Accordingly, the display 350 can include measured values for process depending parameters displayed in MSE graph 352*a*, MSE Scatter graph 352*b*, ROP graph 352*c*, axial vibration graph 352*d*, torsional vibration (stick-slip) graph 352*h*, lateral vibration graph 352*g*, MSE flow rate graph 352*e*, and MSE of the drilling motor or rotary speed graph 352*f*. As should be appreciated, the axes of each graph 352*a* through 352*h* can be modified as needed. For example, as discussed above, bit speed can be displayed as a function of WOB if needed. The display 350 also includes calculated normal, optimal, high, severe and critical values 356*a* through 356*h* for each respective process dependent drilling parameter. In addition, the display can include the normal, optimal, high, severe and critical operating ranges 354*a* through 354*g* for each for each respective process dependent drilling parameter. The user interface can also include a selection icon for causing the optimal drilling parameter set points shown in display 350 to populate digital dials 410 shown in FIG. 4C and discussed below. Thus, the optimal set points and optimal operating ranges can be overlaid upon the normal, high, severe and critical operating ranges and displayed to the drill rig operator.

Figure 4C:
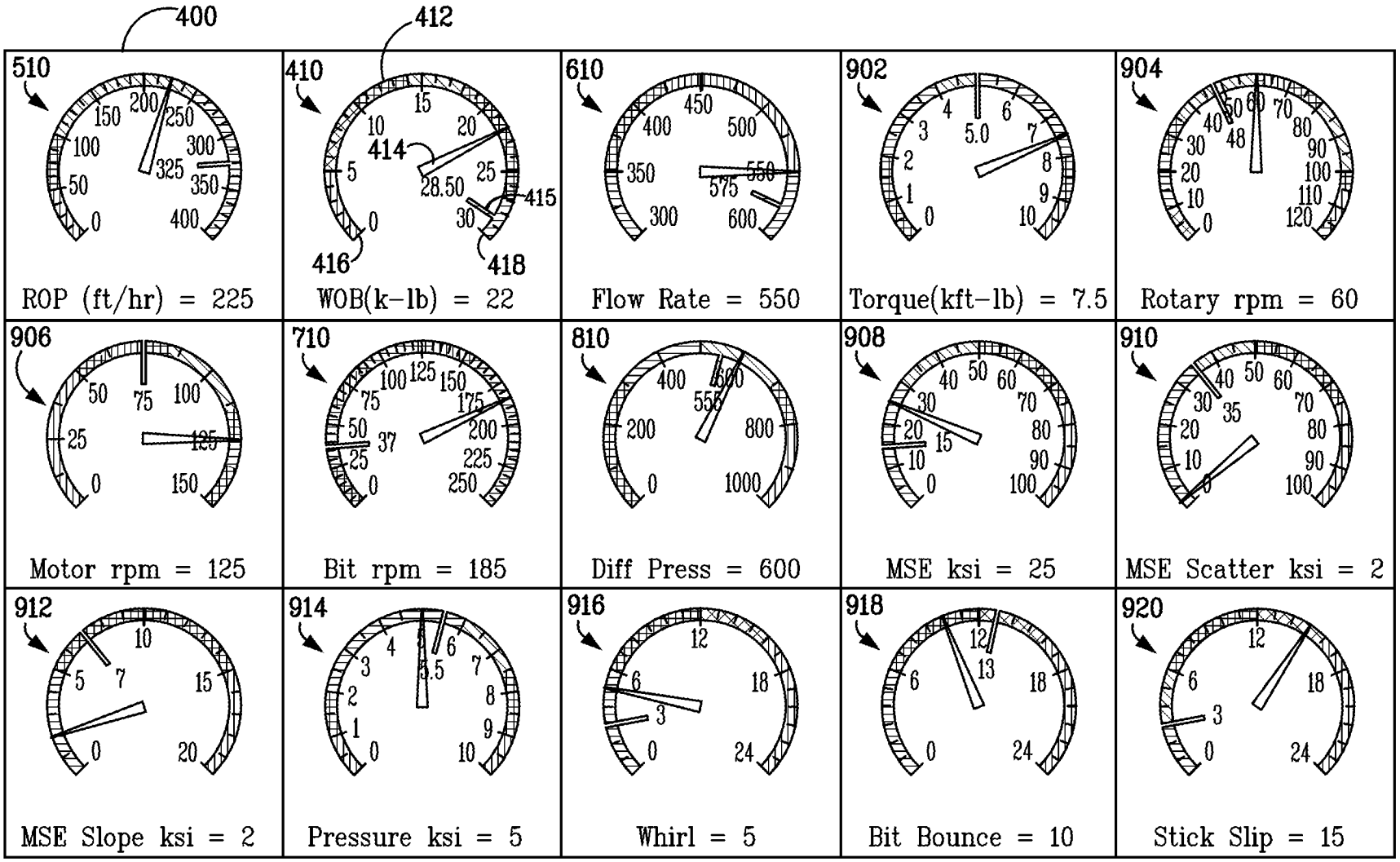
FIGS. 4C and 4D are displays of a graphical user interface associated with the computing device shown in FIG. 2A, showing a plurality of operating ranges and an actual operating parameter for one or more drilling parameters.

Turning to FIG. 4C, the computing device 100, via the software application, causes the user interface to display the visual indication of a first plurality of operating ranges for the one or more drilling operating parameters on a display 400 of an output device, such as a display screen. The display 400 can include a plurality of digital dials that graphically represent 1) the various operating ranges for one or more drilling parameters, 2) the actual operating value of each drilling parameter, and alternatively 3) an operational set point for each drilling parameter.

The display 400 can include a digital dial for each drilling parameter. For instance, the display 400 includes a dial 410 that visually depicts the operating information for the weight on bit (WOB) (k-lb) of a drilling operation. While the display 400 illustrated in FIG. 4C has been configured to show fifteen (15) total drilling parameters, for ease of description, the dial 410 illustrating the WOB is discussed below. It should be appreciated that each dial illustrated includes similar visual representations of specific drilling parameters. The dial 410 includes a curvilinear data band 412 and an actual operating parameter indicator 414, for instance an arrow, which points to the actual measured value for the WOB (illustrated at the 22 k-lb hash mark). Each respective dial has a predefined scale that is specific to the particular drilling parameter. The data band 412 can include end portions 416 and 418 as shown. In an alternate embodiment, the data band 412 can be a circular data band. Further, while a curvilinear data band 412 is shown, the dial 410 can be configured to display a linear data band for each of the parameters.

The data band 412 includes the visual indication of the operating information for drilling parameters. In the illustrated embodiment in FIGS. 4C and 5A, the visual indication of the operating information for WOB includes a plurality of operating ranges for WOB represented in different colors, as discussed above. The optimized operating range 420 can be represented in blue, the normal operating range 430 can be represented in green, the high operating range 440 can be represented in yellow, the severe operating range 451 can be represented in orange, and the critical operation range 450 can be represent in red. The software application causes the user interface to display the operating ranges along each respective dial data band 412 according to the respective color associated with each operating range. For instance, upon selecting the desired drilling operating inputs in display 300 discussed above, in display 400, the software application causes the user interface to display the operating ranges along each respective dial data band 412 associated with its respective color.

Continuing with FIG. 4C, in accordance with the illustrated embodiment, the display 400 includes dials 410, 510, 610, 710 and 810 for each set of controlled drilling parameters, as well as dials 902, 904, . . . 918, 920 for each process dependent drilling parameter. As illustrated, display 400 includes the dial 410 depicting WOB, as discussed above. Dial 510 visually depicts the operating information for the rate of penetration (ROP) (ft/hr) of a drilling operation. Dial 610 visually depicts the operating information for the flow rate of mud flowing through the passage in the drill string 4 during a drilling operation. Dial 710 visually depicts the operating information for the rotational speed (RPM) of the drill bit. Dial 810 visually depicts the operating information for differential pressure (PSI) of a drilling operation. The differential pressure is the difference in pressure between drilling mud passing through drill string 4 in a downhole direction and the pressure of drilling mud passing through the annular passage between the drilling string and borehole wall traveling in an up-hole direction.

As noted the above, the display 400 can also include dials for each process dependent drilling parameter. Dial 902 visually depicts the operating information for the torque (kft-lb) applied to drill string 4 in a drilling operation. Dial 904 visually depicts the operating information for the rotary rotational speed (RMP). Dial 906 visually depicts the operating information for the motor speed (RMP) of a drilling operation. Motor speed in this instance is a measured value that can fall within particular operating range (preferred or less preferred for example) and is process dependent. Dial 908 visually depicts the operating information for the mechanical specific energy (ksi) of a drilling operation. Dial 910 visually depicts the operating information for the measure of scatter or variability of mechanical specific energy (ksi) during a drilling operation. Dial 912 visually depicts the operating information for the slope of the mechanical specific energy (ksi) of a drilling operation. Dial 914 visually depicts the operating information for the standpipe pressure (ksi). Dials 916, 918 and 920 visually depict various parameters associated with drill string vibration. For instance, dial 916 visually depicts the operating information for the whirl of the drill string 4 during a drilling operation. Whirl in this instance is associated with lateral vibration of the drill sting 4 and can be determined via the vibration analysis system 46 as described above. Dial 918 visually depicts the operating information for the measured bit bounce of the drill bit 8 of drilling operation. Bit-bounce in this instance is associated with axial vibration of the drill sting 4 and can be determined via the vibration analysis system 46 as described above. Dial 920 visually depicts the operating information for stick-slip behavior of the drill string 4 for a drilling operation. Stick-Slip in this instance is associated with torsional vibration of the drill string 4 and can be determined via the vibration analysis system 46 as described above.

Figure 4D:
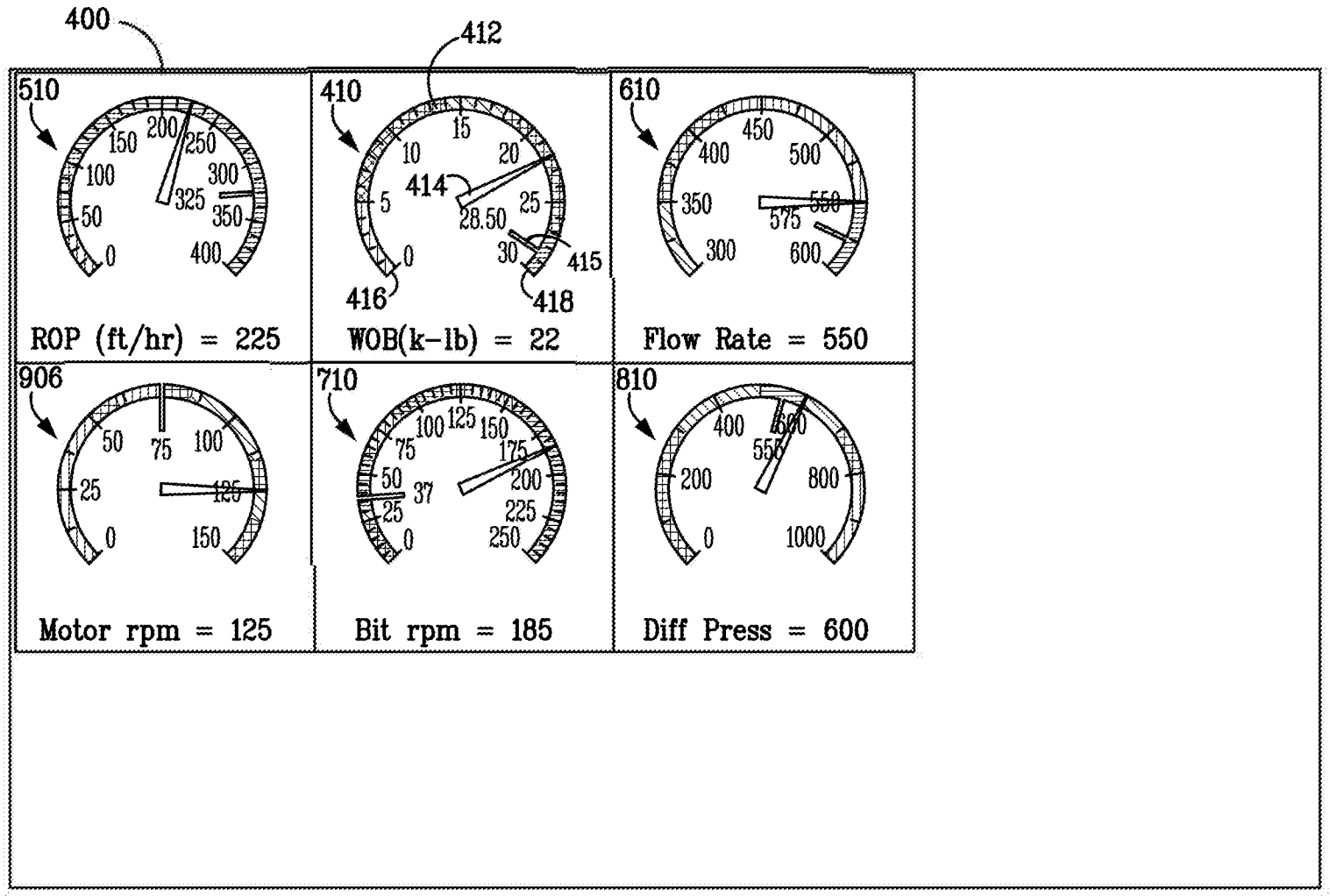

Turning to FIG. 4D, a user 24, via the user interface 108, can modify the display 400 to limit the number of dials shown depicting the drilling operation information. For instance, the display 400 illustrated in FIG. 4C has been configured to show fifteen (15) drilling parameters that include both the controlled and process dependent drilling parameters. The display 400 illustrated in FIG. 4D has been configured to show dials for six (6) drilling parameters, which include dial 510 for ROP, dial 410 for WOB, dial 610 for flow rate, dial 906 for motor rpm, dial 710 for drill bit rotational speed, and dial 810 for differential pressure. It should be appreciated that the user 24, via a user interface, can select any number of dials for depiction on the display 400, using the data entry steps discussed above with respect to the display 300. Thus, the display 400 provides real-time visualization of various operating ranges for each drilling parameter. The displayed operating range is based on actual operating conditions and/or information stored in a database 170 or memory portion 104 regarding the specifics of the bottomhole assembly 6.

The difference between operating in the optimized range 420 and the normal operating range 430 is dependent on the drilling operation and the pre-defined drilling plan. When a drilling parameter is operating in the optimized range 420, one or more additional parameters may fall within a normal operating range 430, for instance, bit whirl is minimized and MSE scatter is low, indicating that the drill string is operating consistent with a pre-defined drill plan. Operation within high or yellow operating range 440 would indicate that the drilling parameters exceed the normal operation range. For instance, the actual ROP in dial 510 may fall within preferred, or green, operating range 430 and the WOB shown in dial 410 and stick-slip shown in dial 920 are illustrated as operating in the high ranges 440 (yellow in each dial 510 and 920). Yet, the drill bit RPM may be shown in dial 710 as operating within the optimal preferred range 420, shown in blue. Operating ROP in the preferred range 420 may be acceptable to the user 24 viewing the display 400, and no specific adjustment in the drilling process controls will be initiated. By providing a visual indication of one or operating ranges for one or more drilling parameters, a user 24 can observe the impact of adjusting drilling parameters on the drilling operation.

As noted above, each drilling parameter can have more than one (for instance a plurality) of operating ranges for each level or operation ranges, e.g. normal, high, severe, and critical. The relationship among each level of operating range may not be linear. For instance, an increase (or decrease) in a value for a drilling parameter does not necessarily mean that the escalation of the operating ranges from normal to critical will be sequential. Referring to FIGS. 4C, 5A and 5B, the WOB can have a first high operating range 440 and a second high operating range 442. The normal or green operating range 430 for WOB can be adjacent to and bounded by the first high operating range 440 and the second high operating range 442. Any linear increase in the WOB from a value of 0 (adjacent end point 416) to the value of 30 (adjacent endpoint 418) does not necessarily indicate the drilling operation will run at optimal WOB as WOB increases.

The computing device 100 can cause the user interface to display each operating range on the digital dial band 412 to account for multiple operating ranges and their relationship along a particular scale of the drilling parameter. As discussed above, the computing device 100, via processing portion 102, can determine the operating range end points for each specific operating range and cause the user interface to display the respective operating ranges in a respective color along the data band of the dial in the display 400. Range endpoints can be defined as the operating value where two operating ranges are adjacent, for instance at WOB equal to 5 (k-lb) (FIG. 5A). The computing device 100, in accordance with the methods described above, displays each operating range and range endpoints (460, 462, 464, . . . 470, 472) (endpoints shown in FIGS. 5A-9B) so as to define the visual indication of each operating range for each drilling parameter.

Referring to FIG. 5A, the computing device 100 can cause the user interface to display a dial 410*a* that includes visual indication of optimized operating range 420 for WOB adjacent to the second high (or less preferred) operating range 442 and adjacent to data band endpoint 418. A second normal (or second preferred) operating range 430 can be adjacent to and between the first and second less high operating ranges 440 and 442. Further, in the illustrated embodiment shown in FIG. 5A, the computing device 100, via a processing portion 102, determined that the critical operating range 450 for the drilling operation is between WOB equal to zero (0) (or data band end portion 416) and WOB equal to 5 (k-lb) at a first end point 460. Further, a severe operating range 451 is between WOB equal to 5 (k-lb), or first endpoint 460, and WOB equal to 10 (k-lb), or a second endpoint 462. The first high range 440 extends from endpoint 462 to endpoint 464, the normal operating range 430 extends from endpoint 464 to endpoint 466, and the second high operating range 442 extends from endpoint 466 to the endpoint 468. The optimized range 420 extends from endpoint 468 to data band endpoint portion 418 (or WOB equal to 30).

Turning now to FIGS. 5A through 9B, the computing device 100 is configured to update the displayed operating ranges to account for changes in drilling conditions over time. As discussed above, the display 400 provides a visual indication of a first plurality of operating ranges for drilling parameters over a first duration of time, for instance one (1) second (s). The display 400 can be updated to provide a visual indication of a second, updated plurality of operating ranges for drilling parameters over a second duration of time, for instance over one (1) second(s). Data can be received by the computing device 100 once every second, although it should be appreciated that data can be received at rates greater than once per second. Upon receipt of the data, the user interface can cause the display of information at least once every one (1) to five (5) seconds. It should be appreciated that the display time data can be faster than one (1) to five (5) seconds. The second duration of time is subsequent to the first duration of time. It should be appreciated the duration of time can be measured in terms of milliseconds, seconds, minutes, or a larger time duration. Further, the display 400 as shown and described herein is a representation of the operating information of a drilling parameter at a discrete or instantaneous moment in time. It should be appreciated that the displays 400 can be dynamic. Thus, while only a first and second duration of time is illustrated described herein, it should be appreciated that multiple, subsequent and continuous updates of the display 400 are possible, in real-time. For instance, the computing device 100 can be configured to cause the continuous update of the display 400 with the additional, updated plurality of operating ranges for the drilling parameters. Thus, when the drilling operation continues, the computing device can cause the optimized operation range to automatically update based on the drilling conditions.

Referring to FIGS. 5A and 5B, the dial 410*a* includes a visual indication of the various operating ranges for WOB of the drilling operation at a first moment of time (or over a first duration of time). The dial 410*b* illustrated in FIG. 5B is a visual indication of the various operating ranges for WOB of the drilling operation at second moment of time (or over a second duration of time). The operating ranges for the WOB in dial 410*b* have been updated based on the actual and/or measured processing conditions of the drilling operation as described above. For instance, based on the drilling operation and data concerning the drilling operating, the optimized operating range has been updated. The computing device 100 has shifted the extent of the optimal preferred operating range 420 from between 27 k-lb-30 k-lb to between 25 k-lb-30 k-lb. The computing device 100 has caused the display of an updated second high operating range 442. The normal range 430 is adjacent to the first and second less high operating ranges 440 and 442.

Figure 6A:
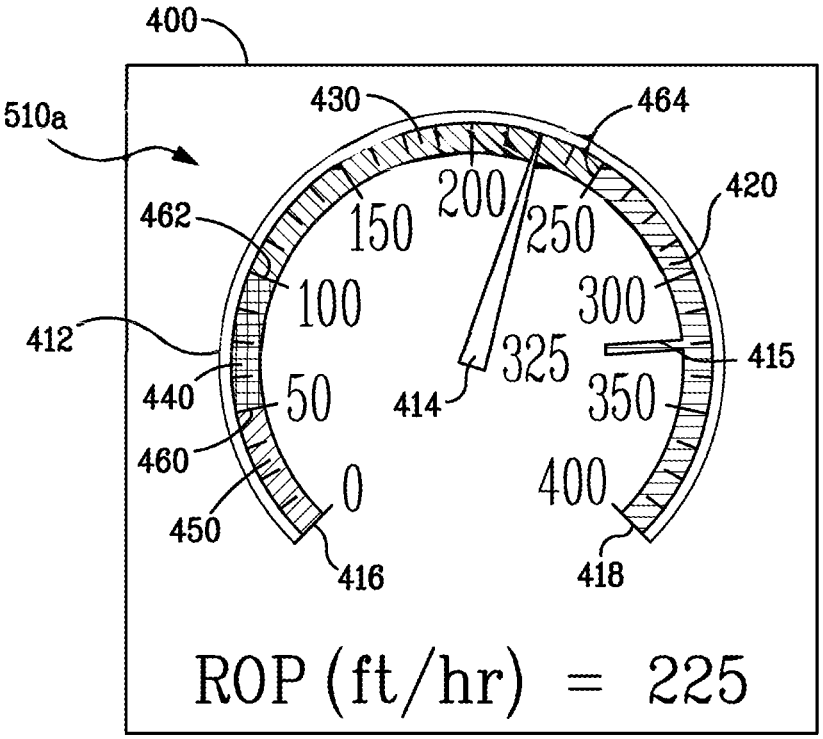
FIGS. 6A and 6B are displays illustrating a portion of the user interface shown in FIGS. 4C and 4D, showing a first plurality of operating ranges for rate of penetration (ROP) and a second, updated plurality of operating ranges for ROP, respectively.
Figure 6B:
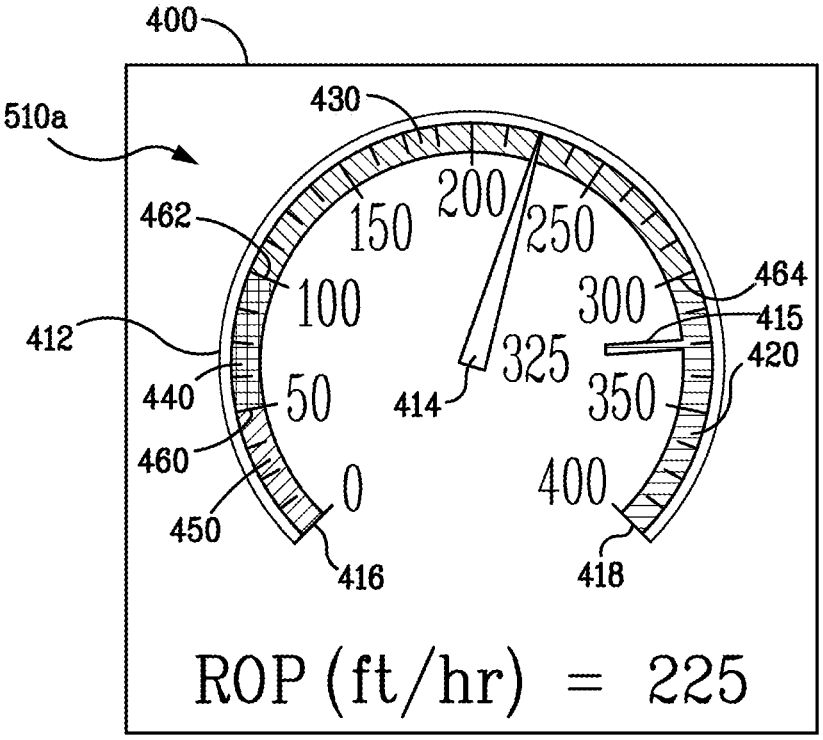

Referring to FIG. 6A, the dial 510*a* includes a visual indication of the various operating ranges for ROP of the drilling operation at a first moment of time (or over a first duration of time). The dial 510*b* illustrated in FIG. 6B, is a visual indication of the various operating ranges for ROP of the drilling operation at a second moment of time (or over a second duration of time). The operating ranges for the ROP in dial 510*b* have been updated based on the actual and/or measured processing conditions of the drilling operation as described above. Specifically, the dials 510*a* and 510*b* (FIGS. 6A and 6B) include the optimized operating range 420, normal operating range 430, high operating range 440 and severe or critical operating range 450. As illustrated in FIG. 6B, the computing device 100 has shifted the extent of the optimal preferred operating range 420 from between 250 to 400 ft/hr to between 300 to 400 ft/hr.

Figure 7A:
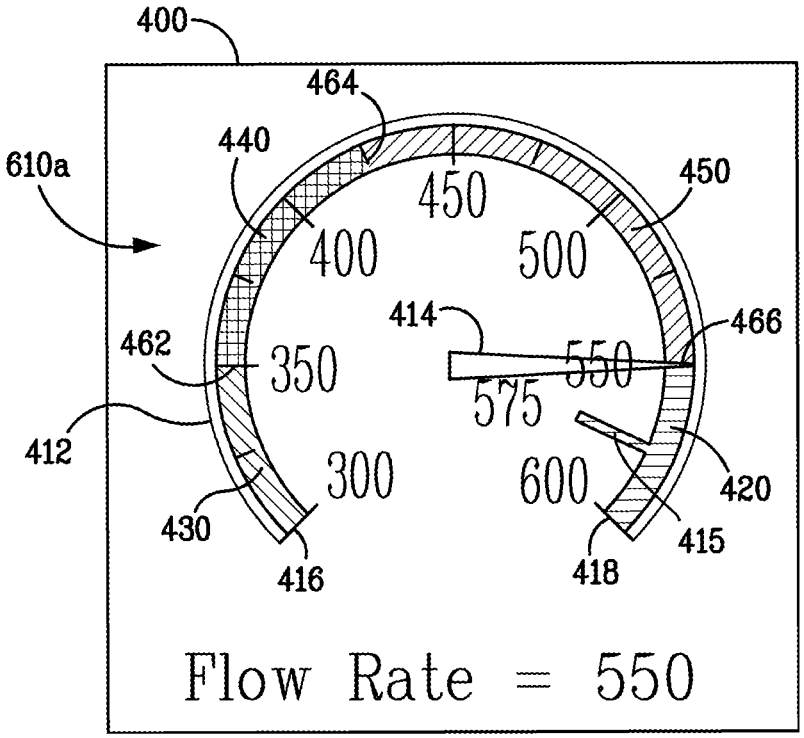
FIGS. 7A and 7B are displays illustrating a portion of the user interface shown in FIGS. 4C and 4D, showing a first plurality of operating ranges for drilling mud flow rate and a second, updated plurality of operating ranges for drilling mud flow rate, respectively.
Figure 7B:
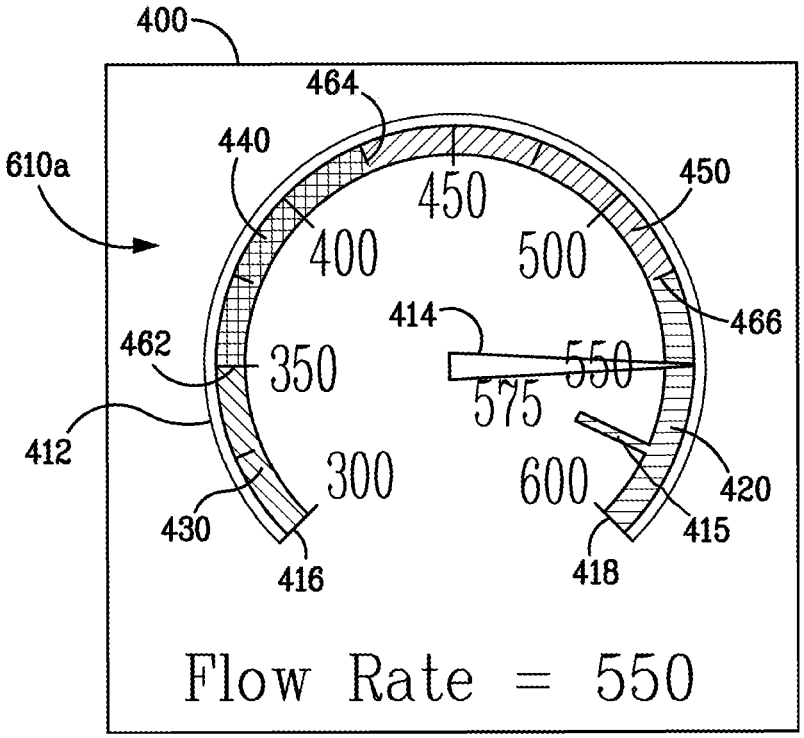

Referring to FIG. 7A, the dial 610*a* includes a visual indication of the various operating ranges for flow rate of drilling mud at a first moment of time, or over a first duration of time. The dial 610*b* illustrated in FIG. 7B, is a visual indication of the various operating ranges for flow of the drilling operation at a second moment of time, or over a second duration of time. The operating ranges for the flow rate in dial 610*b* have been updated based on the actual and/or measured processing conditions of the drilling operation as described above. Specifically, the dials 610*a* and 610*b* (FIG. 7B) include optimized operating range 420, a normal operating range 430, first high operating range 440 and a critical or severe operating range 450. As illustrated in FIG. 7B, the computing device 100 has shifted the extent of the optimal operating range 420.

Figure 8A:
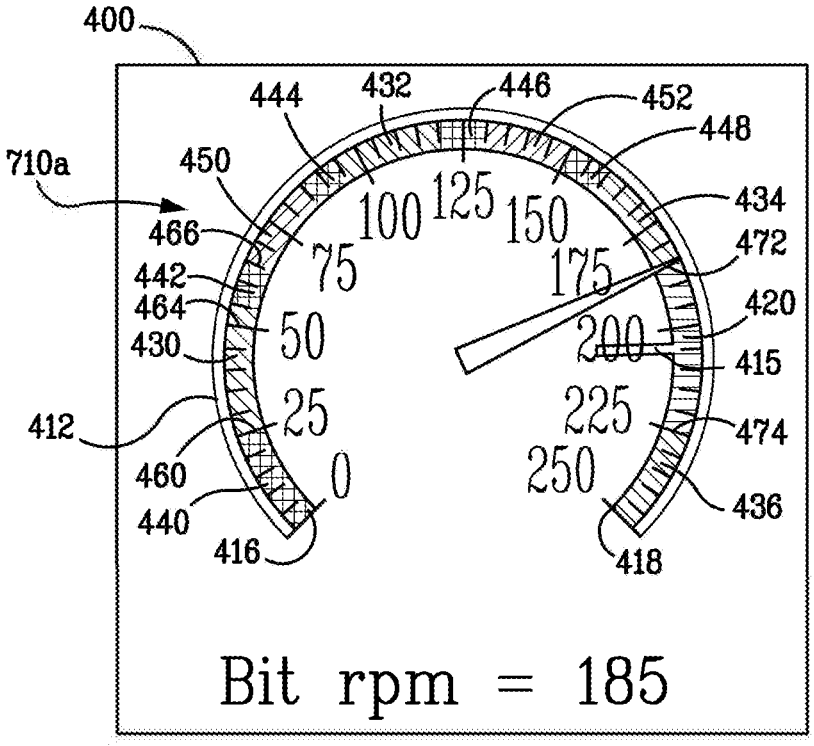
FIGS. 8A and 8B are displays illustrating a portion of the user interface shown in FIGS. 4C and 4D, showing a first plurality of operating ranges for drill bit rotational speed (RPM) and a second, updated plurality of operating ranges for drill bit RPM, respectively.
Figure 8B:
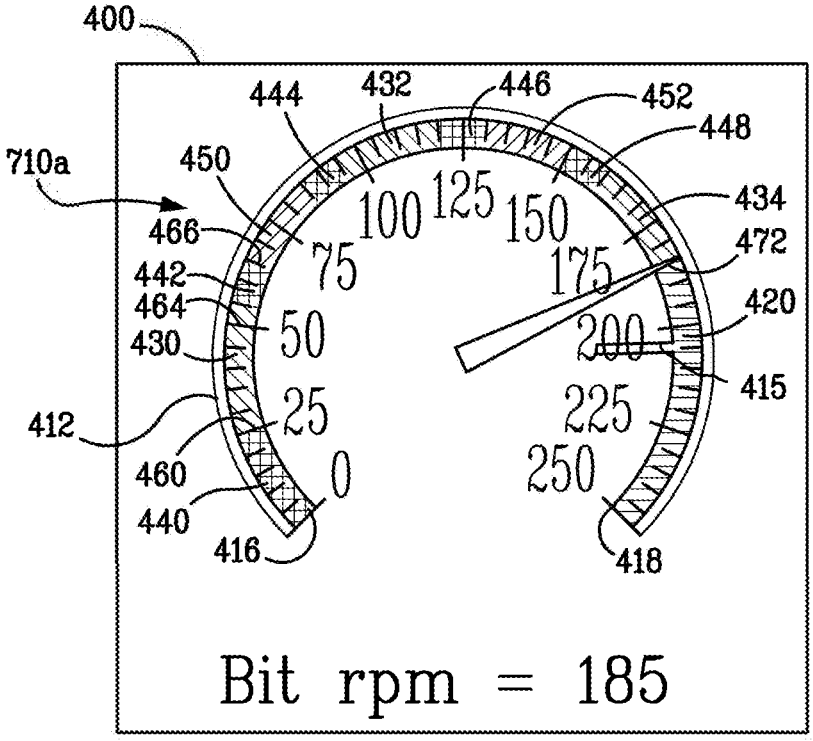

Referring to FIG. 8A, the dial 710*a* includes a visual indication of the various operating ranges for the drill bit rotational speed of the drilling operation at a first moment of time (or over a first duration of time). The dial 710*b* illustrated in FIG. 8B is a visual indication of the various operating ranges for the drill bit rotational speed of the drilling operation at second moment of time (or over a second duration of time). The operating ranges for the drill bit rotational speed in dial 710*b* have been updated based on the actual and/or measured processing conditions of the drilling operation as described above. Specifically, the dials 710*a* and 710*b* (FIGS. 8A and 8B) include an optimized operating range 420, multiple normal operating ranges 430, 432, and 434, multiple high operating ranges 440, 442, 444 and 446, and a pair of critical operating ranges 450 and 452. As illustrated in FIG. 8B, the extent of the optimized range 420 has increased, overlying normal operating range 434, extending to endpoint 448.

Figure 9A:
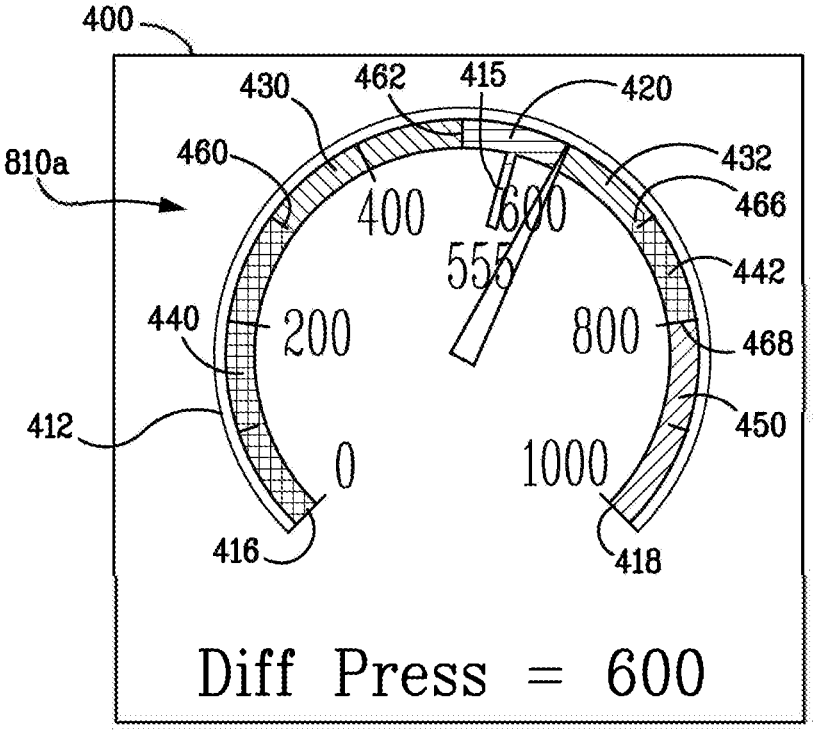
FIGS. 9A and 9B are displays illustrating a portion of the user interface shown in FIGS. 4C and 4D, showing a first plurality of operating ranges for differential pressure and a second, updated plurality of operating ranges for differential pressure, respectively.
Figure 9B:
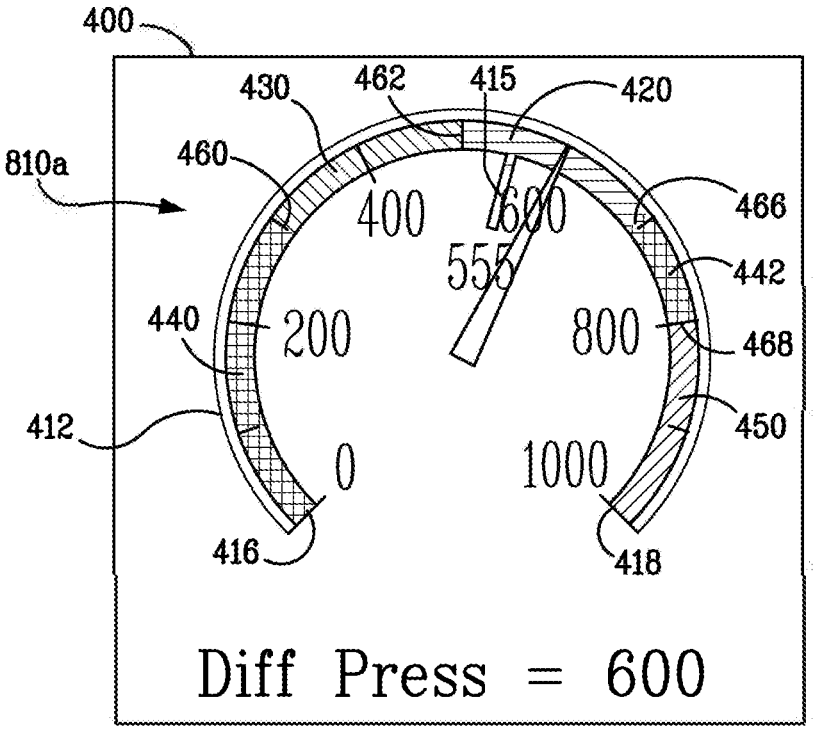

Referring to FIGS. 9A and 9B, the dial 810*a* includes a visual indication of the various operating ranges for the differential pressure of the drilling operation at a first moment of time (or over a first duration of time). The dial 810*b* illustrated in FIG. 9B, is a visual indication of the various operating ranges for the differential pressure of the drilling operation at a second moment of time (or over a second duration of time). The operating ranges for the differential pressure in dial 810*b* have been updated based on the actual and/or measured processing conditions of the drilling operation as described above. Specifically, for the differential pressure, the dials 810*a* and 810*b* (FIGS. 9A and 9B, includes an optimized operating range 420, multiple normal operating ranges 432 and 430, multiple high operating ranges 440 and 442, and a critical operating range 450. As illustrated in FIG. 9B, the extent and position of the optimized and normal operating ranges 420 and 432 have been updated to reflect changing operating conditions of the drilling operation.

While example embodiments of devices for executing the disclosed techniques are described herein, the underlying concepts can be applied to any computing device, processor, or system capable of communicating and presenting information as described herein. The various techniques described herein can be implemented in connection with hardware or software or, where appropriate, with a combination of both. Thus, the methods and apparatuses described herein can be implemented, or certain aspects or portions thereof, can take the form of program code (i.e., instructions) embodied in tangible storage media, such as floppy diskettes, CD-ROMs, hard drives, or any other machine-readable storage medium (computer-readable storage medium), wherein, when the program code is loaded into and executed by a machine, such as a computer, the machine becomes an apparatus for performing the techniques described herein. In the case of program code execution on programmable computers, the computing device will generally include a processor, a storage medium readable by the processor (including volatile and non-volatile memory and/or storage elements), at least one input device, and at least one output device as described above. The program(s) can be implemented in assembly or machine language, if desired. The language can be a compiled or interpreted language, and combined with hardware implementations.

The techniques described herein also can be practiced via communications embodied in the form of program code that is transmitted over some transmission medium, such as over electrical wiring or cabling, through fiber optics, or via any other form of transmission, for instance such as mud telemetry and other data transfers methods for drilling operations described above. When implemented on a general-purpose processor, the program code combines with the processor to provide a unique apparatus that operates to invoke the functionality described herein. Additionally, any storage techniques used in connection with the techniques described herein can invariably be a combination of hardware and software.

While the techniques described herein can be implemented and have been described in connection with the various embodiments of the various figures, it is to be understood that other similar embodiments can be used or modifications and additions can be made to the described embodiments without deviating therefrom. For example, it should be appreciated that the steps disclosed above can be performed in the order set forth above, or in any other order as desired. Further, one skilled in the art will recognize that the techniques described in the present application may apply to any environment, whether wired or wireless, and may be applied to any number of such devices connected via a communications network and interacting across the network. Therefore, the techniques described herein should not be limited to any single embodiment, but rather should be construed in breadth and scope in accordance with the appended claims.

What is claimed:

1. A drilling system for forming a borehole in an earthen formation with a drill string, the system comprising:

a plurality of sensors configured to obtain drilling data during the drilling operation, the drilling data being indicative of one or more drilling parameters of the drilling operation, the plurality of sensors comprising at least one magnetometer or accelerometer;

a computer processor configured to determine in real time during the drilling operation:

1) a first plurality of operating ranges for each of the one or more drilling parameters of the drilling operation based on the drilling data obtained from the plurality of sensors, wherein the first plurality of operating ranges are based on a first duration of time of the drilling operation; and 2) a second, updated plurality of operating ranges for each of the one or more drilling parameters based on the drilling data obtained from the plurality of sensors, wherein the second, updated plurality of operating ranges are based on a second duration of time operating the drill string that is subsequent to the first duration of time; and a graphical user interface configured to, in real time:

A) display one or more curvilinear dials simultaneously during the first duration of time, the one or more curvilinear dials including an operational set point on the curvilinear dials for each drilling parameter, B) display the first plurality of operating ranges for each drilling parameter based on the drilling data as a plurality of curvilinear arcs on the one or more curvilinear dials simultaneously during the first duration of time, wherein each arc has two endpoints, and C) display the second, updated plurality of operating ranges for each drilling parameter based on the drilling data as a plurality of curvilinear arcs on the one or more curvilinear dials during the second duration of time, and display the operational set point for each drilling parameter simultaneously during the second duration of time, such that an extent of the curvilinear arcs between the respective endpoints changes between the first and second durations of time, which reflects changes in the one or more operating parameters.

2. The drilling system of claim 1, wherein the one or more drilling parameters is at least one of a weight-on-bit (WOB), a rate of penetration (ROP), a differential pressure, a drill bit rotational speed, and a drilling mud flow rate.

3. The drilling system of claim 1, wherein each curvilinear arc is associated with a different drilling parameter.

4. The drilling system of claim 1, wherein each one of the first plurality of operating ranges is a different color, wherein each one of the second plurality of operating ranges is a different color.

5. The drilling system of claim 1, further comprising a communication system that is configured to transmit drilling data from the plurality of sensors to the computing device.

6. The drilling system of claim 1, wherein the first and second plurality of operating ranges each include an optimized operating range, a normal operating range, a high operating range, a severe operating range and a critical operating range.

7. The drilling system of claim 1, further comprising a communication system that is configured to transmit drilling data from the plurality of sensors to the computing device.

8. The drilling system of claim 1, wherein the first and second plurality operating ranges includes an optimized operating range, a normal operating range, and a severe operating range.

9. The drilling system of claim 1, wherein the operational set point is a radial extension on the range of the gage.

10. A system having a drill string for forming a borehole in an earthen formation according to one or more drilling parameters, the system comprising:

a plurality of sensors configured to obtain drilling data during the drilling operation, the drilling data being indicative of one or more drilling parameters of the drilling operation, the plurality of sensors comprising at least one magnetometer or accelerometer;

a computer processor configured to:

a) determine a first plurality of operating ranges for the one or more drilling parameters of the drilling operation with the first plurality of operating ranges based on a first duration of time operating the drill string during the drilling operation, and b) determine a second plurality of operating ranges for the one or more drilling parameters with the second plurality of operating ranges based on a second duration of time that is subsequent to the first duration of time such that the second plurality of operation ranges are different from the first plurality of operating ranges; and a graphical user interface configured to:

1) display the first plurality of operating ranges for each drilling parameter simultaneously during the first duration of time as a plurality of curvilinear arcs on one or more curvilinear dials with each arc having end points, 2) display a radial extension of the one or more curvilinear dials for each drilling parameter to represent a set point, and 3) display the second updated plurality of operating ranges and the radial extension of the one or more curvilinear dials for each drilling parameter simultaneously during the second duration of time such that the extent of each of the plurality of curvilinear arcs changes, wherein a) the changes in the extent of each of the plurality of curvilinear arcs reflect changes in the one or more drilling parameters, and b) the first and second plurality of operating ranges are not displayed by the graphical user interface at the same time.

11. The drilling system of claim 10, wherein the one or more drilling parameters is at least one of a weight-on-bit (WOB), a rate of penetration (ROP), a differential pressure, a drill bit rotational speed, and a drilling mud flow rate.

12. The drilling system of claim 10, wherein each curvilinear dial is associated with a different drilling parameter.

13. The drilling system of claim 10, wherein each one of the first plurality of operating ranges is a different color, wherein each one of the second plurality of operating ranges is a different color.

* * * * *